US005110719A

United States Patent [19]

Shuto et al.

[11] Patent Number: 5,110,719

[45] Date of Patent: * May 5, 1992

[54] PROCESS FOR PREPARING A DIRECT POSITIVE PHOTOGRAPHIC MATERIAL

[75] Inventors: Sadanobu Shuto; Hatsumi Tanemura; Shigeo Hirano, all of Kanagawa, Japan

[73] Assignee: Fuji Photo Film Co., Ltd., Kanagawa, Japan

[ * ] Notice: The portion of the term of this patent subsequent to Jan. 14, 2009 has been disclaimed.

[21] Appl. No.: 611,373

[22] Filed: Nov. 13, 1990

Related U.S. Application Data

[62] Division of Ser. No. 403,509, Sep. 6, 1989, abandoned.

[30] Foreign Application Priority Data

Sep. 6, 1988 [JP] Japan ..... 63-221483

[51] Int. Cl.[5] ..... G03C 1/485; G03C 1/005

[52] U.S. Cl. ..... 430/569; 430/567; 430/607; 430/608; 430/611; 430/598; 430/940

[58] Field of Search ..... 430/611, 598, 607, 608, 430/409, 410, 567, 569, 940

[56] References Cited

U.S. PATENT DOCUMENTS

| | | | |
|---|---|---|---|
| 2,057,764 | 10/1936 | Brunken | 95/8 |
| 2,394,198 | 2/1946 | Mueller | 430/607 |
| 3,384,490 | 5/1968 | Rees | 96/110 |
| 4,198,240 | 4/1980 | Mikawa | 430/570 |
| 4,801,520 | 1/1989 | Inoue et al. | 430/378 |

FOREIGN PATENT DOCUMENTS

| | | |
|---|---|---|
| 0249239 | 6/1987 | European Pat. Off. . |
| 0293917 | 12/1988 | European Pat. Off. . |
| 0327066 | 2/1989 | European Pat. Off. . |

OTHER PUBLICATIONS

Research Disclosure No. 235, Nov. 1983, Havant GB, pp. 346-352, "Development Nucleation by Hydrazine & Hydrazine Derivatives".

European Search Report dated Apr. 12, 1990.

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A process for preparing a direct positive photosensitive material comprising providing on a support at least one silver halide light-sensitive emulsion layer containing the combination of (a) non-prefogged internal latent image silver halide grains; (b) a binder; (c) at least one compound represented by formulae (I), (II), or (III); and at least one compound represented by formula (IV):

$$R—SO_2S—M \quad (I)$$

$$R—SO_2S—R^1 \quad (II)$$

$$R—SO_2S—L_m—S.O_2S—R^2 \quad (III)$$

wherein R, $R^1$ and $R^2$ each represents a substituted or unsubstituted aliphatic group, a substituted or unsubstituted aromatic group or a substituted or unsubstituted heterocyclic group; M represents a cation; L represents a divalent linking group; and m is 0 or 1; and $$R^3—SO_2—M^1 \quad (IV)$$

wherein $R^3$ represents an aliphatic group, an aromatic group or a heterocyclic group; and $M^1$ represents a cation. The material provides a direct positive image with high Dmax, low Dmin and high contrast.

17 Claims, 1 Drawing Sheet

PROCESS FOR PREPARING A DIRECT POSITIVE PHOTOGRAPHIC MATERIAL

This is a divisional of application Ser. No. 07/403,509, filed Sept. 6, 1989, now abandoned.

FIELD OF THE INVENTION

This invention relates to direct positive photographic materials which have at least one photographic emulsion layer of which the minimum image density (Dmin) is reduced without reduction of the maximum image density (Dmax), and which contains internal latent image type silver halide grains which have not been prefogged.

BACKGROUND OF THE INVENTION

Methods by means of which direct positive images are obtained using internal latent image type silver halide emulsions which have not been pre-fogged by carrying out imagewise exposure followed by surface development after carrying out a fogging process or while carrying out a fogging process are well known.

Herein, the term "internal latent image type silver halide emulsion" signifies a silver halide of the type in which the photosensitive nuclei are principally within the silver halide grains, and in which the latent image formed by exposure to light is formed principally within the grains.

Various techniques are known in this field of technology. For example, the principal techniques have been disclosed, for example, in the specifications of U.S. Pat. Nos. 2,592,250, 2,466,957, 2,497,875, 2,588,982, 3,317,322, 3,761,266, 3,761,276, 3,796,577, 1,151,363, 1,150,553 and 1,011,062.

It is possible to provide comparatively fast direct positive photographic materials using these known techniques.

Details of the mechanism by which the above mentioned direct positive images are formed have been described, for example, in T. H. James *The Theory of the Photographic Process*, volume 4, chapter 7, pages 182–193, and in U.S. Pat. No. 3,761,276.

The inventors have already invented a method in which high contrast direct positive photosensitive materials which have a low Dmin value obtained by including thiosulfonic acid in the emulsion, and a patent application has been made in this connection (Japanese Patent Application No. 63-83677).

Moreover, various additives are added to the photographic materials in general in order to improve their photographic characteristics, and the use of mixtures of thiosulfonic/sulfinic acids in black-and white negative photosensitive materials has been disclosed in U.S. Pat. No. 2,394,198, where mainly sulfinic acid with just a small amount of thiosulfonic acid is added.

In order to be practical, direct positive photographic materials must have a high Dmax, a low Dmin and a high contrast. However, when additives are added to direct positive photographic materials in particular to reduce Dmin they also tend to reduce the value of Dmax.

High contrast direct positive photographic materials which have a low Dmin value can be obtained with the method of the aforementioned Japanese Patent Application No. 63-83677, but these materials have disadvantages, namely (1) that the fresh speed is low, and (2) that the change in speed (sensitization) on aging during storage is also considerable.

SUMMARY OF THE INVENTION

An object of the present invention is to obtain a direct positive photographic material having high photosensitivity and high contrast, which is capable of reducing the minimum image density (Dmin) without reducing the maximum image density (Dmax).

Another object of the present invention is to obtain a direct positive photographic material, which shows little deterioration in photographic properties during storage thereof.

According the present invention there is to provided a method for preparing a direct positive photosensitive material comprising providing on a support at least one silver halide light-sensitive emulsion layer comprising the combination of (a) non-prefogged internal latent image silver halide grains; (b) a binder; (c) at least one compound represented by formulae (I), (II) or (III); and at least one compound represented by formula (IV):

$$R—SO_2S—M \quad (I)$$

$$R—SO_2S—R^1 \quad (II)$$

$$R—SO_2S—L_m—S.O_2S—R^2 \quad (III)$$

wherein R, $R^1$ and $R^2$ each represents a substituted or unsubstituted aliphatic group, a substituted or unsubstituted aromatic group or a substituted or unsubstituted heterocyclic group; M represents a cation; L represents a divalent linking group; and m is 0 or 1; and $$R^3—SO_2—M^1 \quad (IV)$$

wherein $R^3$ represents a substituted or unsubstituted aliphatic group, a substituted or unsubstituted aromatic group or a substituted or unsubstituted heterocyclic group; and $M^1$ represents a cation.

DETAILED DESCRIPTION OF THE INVENTION

Figure 1:
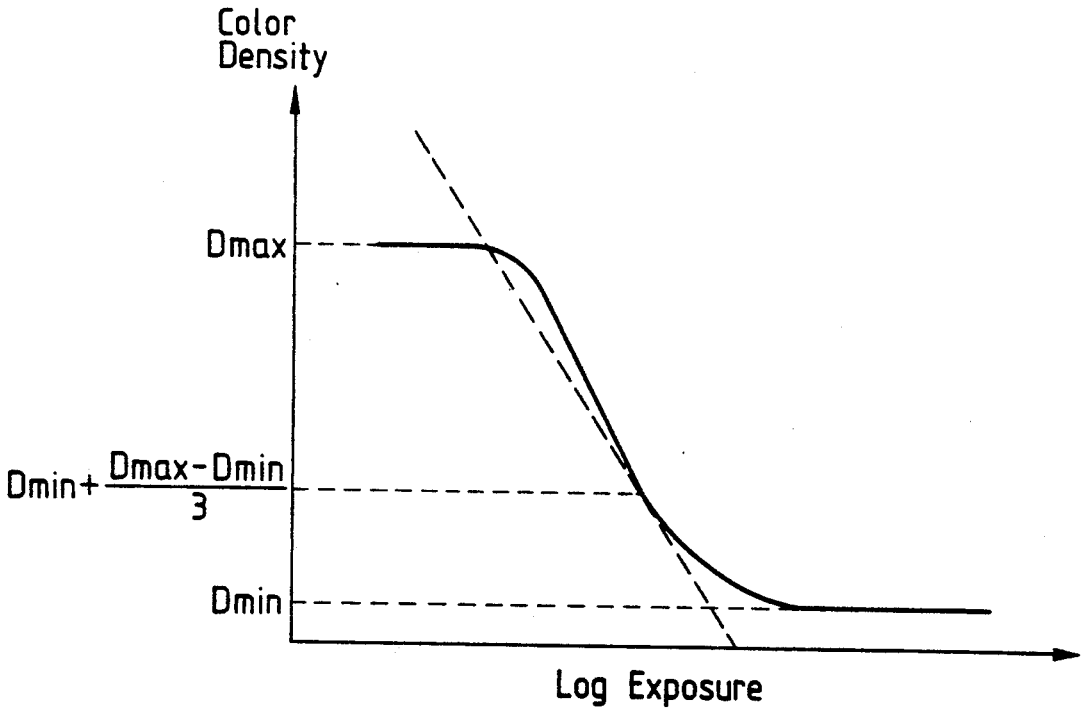
FIG. 1 shows a characteristic curve for a direct positive material.

Compounds represented by formulae (I), (II) and (III) are described in greater detail below.

$$R—SO_2S—M \quad \text{General Formula (I)}$$

$$R—SO_2S—R^1 \quad \text{General Formula (II)}$$

$$R—SO_2S—L_m—S.O_2S—R^2 \quad \text{General Formula (III)}$$

In these formulae, R, $R^1$ and $R^2$ may be the same or different, each representing an aliphatic group, an aromatic group or a heterocyclic group, and M represents a cation. L represents a divalent linking group and m is 0 or 1.

When R, $R^1$ and $R^2$ are aliphatic groups, they are preferably alkyl groups which have form 1 to 22 carbon atoms, or alkenyl or alkynyl groups which have from 2 to 22 carbon atoms, and these groups may have substituent groups. Examples of alkyl groups include methyl, ethyl, propyl, butyl, pentyl, hexyl, octyl, 2-ethylexyl, decyl, dodecyl, hexadecyl, octadecyl, cyclohexyl, isopropyl and t-butyl groups.

Examples of alkenyl groups include allyl and butenyl groups.

Examples of alkynyl groups include propargyl and butynyl groups.

The preferred aromatic groups for R, $R^1$ and $R^2$ have from 6 to 20 carbon atoms and include phenyl and naphthyl groups. These groups may also have substituent groups.

The heterocyclic groups represented by R, $R^1$ and $R^2$ are three to fifteen-membered rings which have at least one atom selected from among nitrogen, oxygen, sulfur, selenium and tellurium, including for example, pyrrolidine, piperidine, pyridine, tetrahydrofuran, thiophene, oxazole, thiazole, imidazole, benzothiazole, benzoxazole, benzimidazole, selenezole, benzoselenazole, tellurazole, triazole, benzotriazole, tetrazole, oxadiazole or thiadiazole rings.

Examples of substituent groups for R, $R^1$ and $R^2$ include alkyl groups (for example, methyl, ethyl, hexyl), alkoxy groups (for example, methoxy, ethoxy, octyloxy), aryl groups (for example, phenyl, naphthyl, tolyl), hydroxyl groups, halogen atoms (for example, fluorine, chlorine, bromine, iodine), aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups (for example, acetylamino, benzoylamino), sulfonylamino groups (for example, methanesulfonylamino, benzenesulfonylamino), acyloxy groups (for example, acetoxy, benzoxy), carboxyl groups, cyano groups, sulfo groups and amino groups.

L is preferably a divalent aliphatic group or a divalent aromatic group. Examples of divalent aliphatic groups include $-(CH_2)_m-$ (where n=1-12), $-CH_2-CH=CH-CH_2-$, $-CH_2C\equiv CCH_2-$,

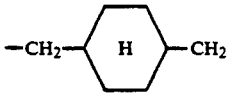

and xylylene groups. Examples of divalent aromatic groups include phenylene and naphthylene groups.

These groups may also be substituted with the substituent groups described above.

M is preferably a metal ion or an organic cation. Examples of metal ions include lithium, sodium and potassium ions. Examples of organic cations include ammonium ions (for example, ammonium, tetramethylammonium, tetrabutylammonium), phosphonium ions (for example, tetraphenylphosphonium), and a guanidyl group.

Specific examples of compounds represented by formulae (I), (II) and (III) are indicated below, but the invention is not to be construed as being limited to these examples.

$CH_3SO_2SNa$ (I-1)

$C_2H_5SO_2SNa$ (I-2)

$C_3H_7SO_2SK$ (I-3)

$C_4H_9SO_2SLi$ (I-4)

$C_6H_{13}SO_2SNa$ (I-5)

$C_8H_{17}SO_2SNa$ (I-6)

$CH_3(CH_2)_3CH(C_2H_5)CH_2SO_2S.NH_4$ (I-7)

$C_{10}H_{21}SO_2SNa$ (I-8)

$C_{12}H_{25}SO_2SNa$ (I-9)

$C_{16}H_{33}SO_2SNa$ (I-10)

$(CH_3)_2CH-SO_2SK$ (I-11)

$(t)C_4H_9SO_2SNa$ (I-12)

$CH_3OCH_2CH_2SO_2S.Na$ (I-13)

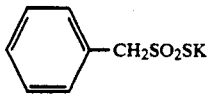

(I-14)

$CH_2=CHCH_2SO_2SNa$ (I-15)

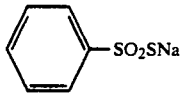

(I-16)

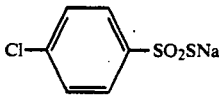

(I-17)

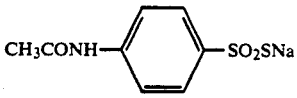

(I-18)

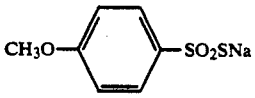

(I-19)

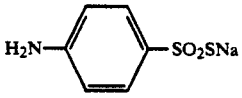

(I-20)

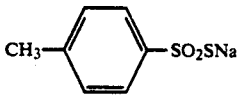

(I-21)

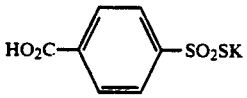

(I-22)

-continued
(I-23)
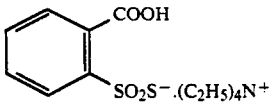
(I-24)
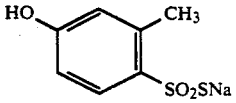
(I-25)
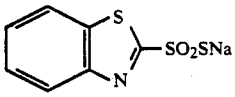
(I-26)
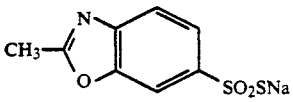
(I-27)
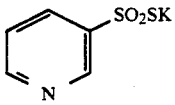
(I-28)
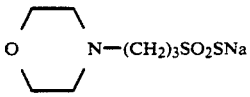
$C_2H_5SO_2S—CH_3$ (II-1)
$C_8H_{17}SO_2SCH_2CH_3$ (II-2)
(II-3)
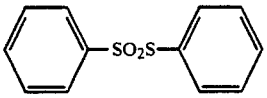
(II-4)
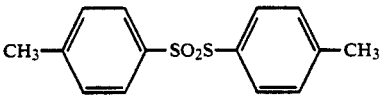
$C_2H_5SO_2SCH_2CH_2CN$ (II-5)
(II-6)
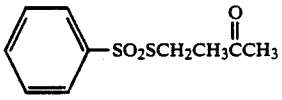
(II-7)
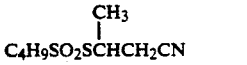
(I-8)
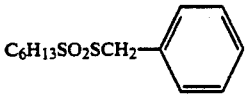
(II-9)
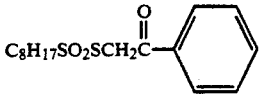
-continued
(II-10)
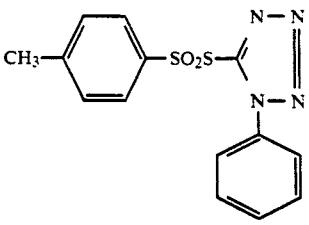
(II-11)
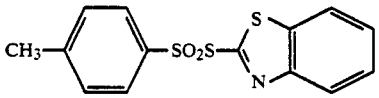
(II-12)
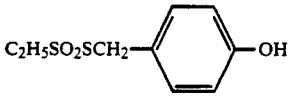
(II-13)
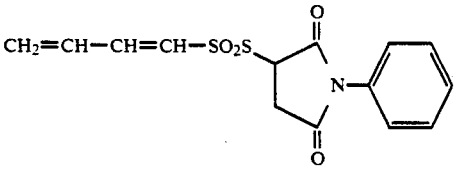
(II-14)
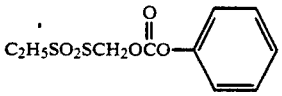
(II-15)
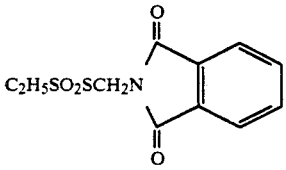
(II-16)
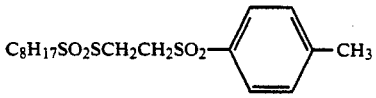
(II-17)
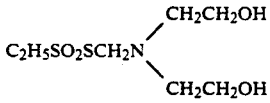
$C_2H_5SO_2SCH_2CH_2CH_2CH_2OH$ (II-18)
(II-19)
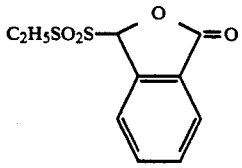
(II-20)
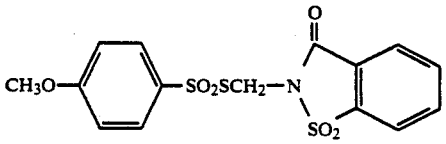
(III-1)
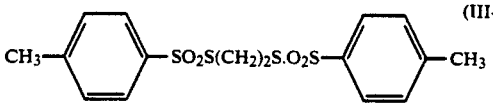

-continued $C_2H_5SO_2SCH_2CH_2CH_2SO_2CH_2CH_2S.O_2SC_2H_5$ (III-2)

(III-3)

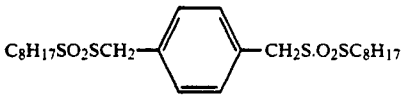

$C_2H_5SO_2SCH_2N(CH_2CH_2)NCH_2S.O_2SC_2H_5$ (III-4)
$CH_2CH_2OH$ $CH_2CH_2OH$ (III-5)

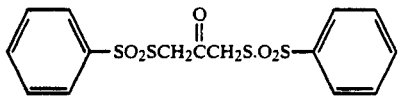

(III-6)

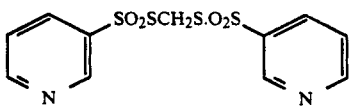

The compounds of general formulae (I), (II) and (III) can be prepared easily using the methods disclosed in JP-A No. 54-1019 and British Patent No. 972,211. (The term "JP-A" as used herein signifies an "unexamined published Japanese patent application".)

Among compounds represented by formulae (I), (II) and (III), those represented by formula (I) are preferred.

The compounds represented by formulae (I), (II) and (III) of this invention are included in a photographic emulsion layer which contains internal latent image type silver halide grains of this invention.

The method of addition may involve addition to the coating liquid which contains the emulsion grains immediately before coating, but pre addition to the emulsion of this invention is preferred. The compounds represented by formulae (I), (II) and (III) of this invention are preferably added during the formation of the internal latent image type silver halide grains of this invention. Most desirably the compounds represented by formulae (I), (II) and (III) are added during core grain formation, or during the chemical sensitization or conversion of the core grains, during the formation of a core/shell emulsion.

The amount of the compound represented by formulae (I), (II) or (III) used is generally within the range from $10^{-6}$ to $10^{-2}$ mol, and preferably within the range from $10^{-5}$ to $10^{-2}$ mol, per mol of the internal latent image type silver halide of this invention.

The compounds represented by formulae (I), (II) and (III) may be used individually, or two or more types may be used together.

The compounds represented by formula (IV) are described in greater detail below.

$R^3—SO_2—M^1$ General Formula (IV)

$R^3$ and $M^1$ in this formula have the same significances as R and M in formula (I) respectively.

Apecific examples of compounds represented by formula (IV) are indicated below, but the present invention is not to be construed as being limited to these examples.

$CH_3SO_2Na$ (IV-1)

$C_2H_5SO_2Na$ (IV-2)

$C_3H_7SO_2K$ (IV-3)

$C_4H_9SO_2Li$ (IV-4)

$C_6H_{13}SO_2Na$ (IV-5)

$C_8H_{17}SO_2Na$ (IV-6)

$CH_3(CH_2)_3CH(C_2H_5)CH_2SO_2.NH_4$ (IV-7)

$C_{10}H_{21}SO_2Na$ (IV-8)

$C_{12}H_{25}SO_2Na$ (IV-9)

$C_{16}H_{33}SO_2Na$ (IV-10)

$(CH_3)_2CHSO_2Na$ (IV-11)

$(t)C_4H_9SO_2Na$ (IV-12)

$CH_3OCH_2CH_2SO_2Na$ (IV-13)

(IV-14)

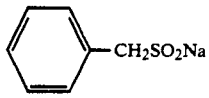

$CH_2{=}CHCH_2SO_2Na$ (IV-15)

(IV-16)

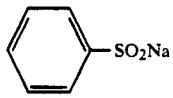

(IV-17)

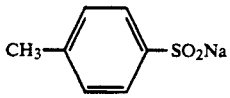

(IV-18)

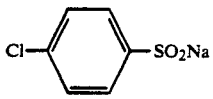

(IV-19)

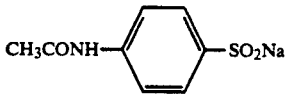

(IV-20)

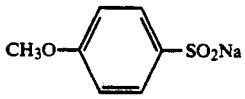

(IV-21)

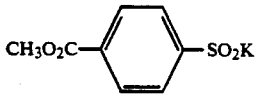

(IV-22)

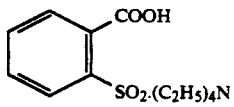

-continued

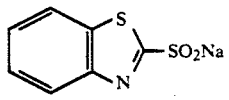
(IV-23)

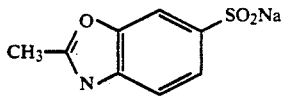
(IV-24)

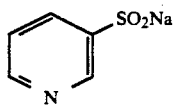
(IV-25)

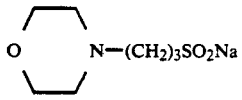
(IV-26)

The compounds represented by formula (IV) can be prepared easily by the methods described in *Organic Functional Group Preparation*, by S. R. Sandler and W. Karo, (Academic Press, New York and London, 1968), pages 519–524, and the publications referred to therein.

The compounds represented by formula (IV) of this invention are included in a photographic emulsion layer which contains internal latent type silver halide grains of this invention.

The method of inclusion may involve addition to the coating liquid which contains the emulsion grains immediately before coating, but pre-addition to the emulsion of this invention is preferred. The compound represented by formula (IV) of this invention is preferably added during the formation of the internal latent image type silver halide grains of this invention. Most desirably, the compound represented by formulae (IV) is added during the core grain formation, or during the chemical sensitization or conversion of the core grains.

The amount of the compound represented by formula (IV) used is generally within the range from $10^{-7}$ to $10^{-3}$ mol, and preferably within the range from $10^{-6}$ to $10^{-3}$ mol, per mol of internal latent image type silver halide of this invention.

At least one compound represented by formula (I), (II) or (III) of this invention and a compound represented by formula (IV) can be added at different times, being added to the coating liquid which contains the internal latent image type silver halide grains of this invention or to the emulsion, but the simultaneous addition of these compounds is preferred.

Furthermore, at least one compound represented by formulae (I), (II) or (III) and a compound represented by the general formula (IV) may be added to a coating liquid which contains internal latent image type silver halide grains or to the emulsion in the form of a solution in which they have been pre-mixed with water or an organic solvent.

Preferable combination of these compounds is the compound of formula (I) and the compound of formula (IV).

The amount of the compounds of this invention present within the silver halide grains can be determined by immersing the grains in a dilute solution of a silver halide solvent, dissolving the surface region of the grains and then removing the grains and carrying out an analysis. At this time it is possible to determine the amounts of the compounds of this invention which are present near the surface or the amounts which are present at a depth within the grains by varying the extent of the dissolution.

The non-prefogged internal latent image type silver halide emulsions of this invention are emulsions which contain silver halides in which the latent image is formed principally within silver halide grains, and in which the surfaces have not been pre-fogged. More precisely, these emulsions are such that when a specific quantity of the silver halide emulsion (0.5–3 g/m$^2$) is coated onto a transparent support, exposed for a specific time of from 0.01 to 10 seconds and developed in the development bath A indicated below (an internal type development bath) for 5 minutes at 18° C., the maximum density measured using a normal method for making photographic density measurements is preferably at least five times, and most desirably at least ten times, the maximum density obtained when the silver halide emulsion has been coated and exposed in the same way as described above and developed for 6 minutes at 20° C. in the development bath B indicated below (a surface type development bath).

| | |
|---|---|
| **Internal Development Bath A:** | |
| Metol | 2 g |
| Sodium sulfite (anhydrous) | 90 g |
| Hydroquinone | 8 g |
| Sodium carbonate (mono-hydrate) | 52.5 g |
| KBr | 5 g |
| KI | 0.5 g |
| Water | to make up to 1 liter |
| **Surface Development Bath B:** | |
| Metol | 2.5 g |
| L-Ascorbic acid | 10 g |
| $NaBO_2.4H_2O$ | 35 g |
| KBr | 1 g |
| Water | to make up to 1 liter |

Specific examples of internal latent image type emulsions include, for example, the conversion type silver halide emulsions disclosed in the specification of U.S. Pat. No. 2,592,250, and the core/shell type silver halide emulsions disclosed in U.S. Pat. Nos. 3,761,276, 3,850,637, 3,923,513, 4,035,185, 4,395,478 and 4,504,570, JP-A Nos. 156614, 55-127549, 53-60222, 56-22681, 59-208540, 60-107641, 61-3137, 62-215272 and in the patents cited in *Research Disclosure* No. 23510 (published November 1983) page 236.

The form of the silver halide grains used in the invention may be a regular crystalline form such as cubic, octahedral, dodecahedral or tetradecahedral, or an irregular crystalline form such as spherical; or grains which have a tabular form in which the length/thickness ratio is at least 5. Furthermore, grains which have a complex form consisting of various crystalline forms and emulsion consisting of mixtures of these grain types can be used.

The composition of the silver halide may be silver chloride, silver bromide or a mixed halide of silver, but the preferred silver halides in this invention are silver chloro(iodo)bromides, silver (iodo)chlorides or silver (iodo)bromides which either contains no silver iodide or which contain not more than 3 mol% of silver iodide.

The average grain size of the silver halide grains is preferably not more than 2 μm but at least 0.1 μm, and most desirably the grain size is not more than 1 μm but at least 0.15 μm. The average grain size distribution may be narrow or wide but the use in this invention of "mono-disperse" silver halide emulsions, in which the grain size distribution is so narrow that at least 90%, in terms of the number or weight of the grains, of all the grains have a grain size within ±40%, and preferably within ±20%, of the average grain size is preferred for improving graininess and sharpness. Furthermore, two or more types of mono-disperse silver halide emulsion which have different grain sizes, or a two or more types of grains which have different speeds and the same size, can be mixed in the same layer or can be coated in a separate laminated layers which have essentially the same color sensitivity in order to provide the target gradation of the photosensitive material. Moreover, combinations of two or more types of poly-disperse silver halide emulsion or mono-disperse emulsion can also be used either in the form of mixtures or laminates.

The silver halide emulsions used in the invention can be chemically sensitized internally or at the surface using sulfur or selenium sensitization, reduction sensitization and noble metal sensitization either individually or conjointly. Detailed examples have been disclosed, for example, in the patents cited in *Research Disclosure* No. 17643-III (published December 1978), page 23.

The photographic emulsions used in the invention may be spectrally sensitized in any conventional way using photographic sensitizing dyes. Dyes classified as cyanine dyes, merocyanine dyes and complex merocyanine dyes are especially useful in this connection, and these dyes may be used individually or in combinations. Furthermore, super-sensitizers can also be used together with the above mentioned dyes. Detailed examples have been disclosed, for example, in the patents cited in *Research Disclosure* No. 17643-IV (published December 1978), pages 23–24.

Anti-fogging agents or stabilizers can be included in the photographic emulsions used in the invention with a view to preventing the occurrence of fogging during the manufacture, storage or photographic processing of the photosensitive materials and stabilizing photographic performance. Detailed examples have been described, for example, in *Research Disclosure* No. 17643-IV (published December 1978) and by E. J. Birr in *Stabilization of Photographic Silver Halide Emulsion*, published by the Focal Press, 1974.

Various color couplers can be used to form direct positive color images in this invention. Color couplers are compounds which undergo a coupling reaction with the oxidized form of primary aromatic amine developing agents and form or release dyes which are essentially nondiffusible, and they are themselves preferably compounds which are essentially nondiffusible. Naphthol or phenol based compounds, pyrazolone or pyrazoloazole based compounds and open chain or heterocyclic ketomethylene based compounds are typical examples of useful color couplers. Specific examples of these cyan, magenta and yellow couplers include the compounds disclosed in *Research Disclosure* No. 17643 (published December 1978) page 25, section VII-D, *Research Disclosure* No. 18717 (published November 1979) and JP-A No. 62-215272, and in the patents cited in these publications.

Colored couplers for correcting unwanted absorbance on the short wavelength side of the dyes which are formed; couplers forming a dye with a suitable degree of diffusibility; non-color forming couplers; DIR couplers which release development inhibitors as the coupling reaction proceeds; and polymerized couplers can also be used.

Gelatin is useful as a binding agent or protective colloid which can be used as the binder in the emulsion layers and intermediate layers of the photosensitive materials of this invention, but other hydrophilic colloids can also be used for this purpose.

Anti-color fogging agents and anti-color mixing agents can be used in the photosensitive materials of this invention.

Typical examples of these compounds have been disclosed on pages 185–193 of JP-A No. 62-215272.

Color intensifiers can be used for improving the color forming properties of the couplers in this invention. Typical examples of such compounds have been disclosed on pages 121–125 of JP-A No. 62-215272.

Dyes for preventing the occurrence of irradiation and halation, ultraviolet absorbers, plasticizers, fluorescent whiteners, matting agents, agents for preventing the occurrence of aerial fogging, coating promotors, film hardening agents, anti-static agents and slip improving agents can be added to the photosensitive materials of this invention. Typical examples of these additives have been disclosed in *Research Disclosure* No. 17643, sections VII-XIII (published December 1978) pages 25–27, and Research Disclosure No. 18716 (published November 1979) pages 647–651.

The invention can also be applied to multi-layer, multi-color photographic materials which have at least two different spectral sensitivities on a support.

Multi-layer, natural color photographic materials normally have at least one red sensitive emulsion layer, at least one green sensitive emulsion layer and at least one blue sensitive emulsion layer on a support. The order in which these layers are arranged can be varied as required. The preferred orders for the layer arrangement are, from the support, red sensitive layer, green sensitive layer, blue sensitive layer and, from the support, green sensitive layer, red sensitive layer, blue sensitive layer. Furthermore, each of the emulsion layers may consist of two or more emulsion layers which have different speeds, and non-photosensitive layers may be present between two or more emulsion layers which have the same color sensitivity. Cyan forming couplers are normally included in the red sensitive emulsion layers, magenta forming couplers are normally included in the green sensitive emulsion layer and yellow couplers are normally included in the blue sensitive emulsion layer, but different combinations can be used, depending on the particular case.

As well as the silver halide emulsion layers, auxiliary layers such as protective layers, intermediate layers, filter layers, anti-halation layers, backing layers and white reflecting layers, may be used without limitation in the photographic materials of this invention.

The photographic emulsion and other layers in the photographic materials of this invention are coated onto a support as disclosed in *Research Disclosure* No. 17643, chapter VVII (published December 1978), page 28, European Patent No. 0,102,253 or JP-A No. 61-97655. Furthermore, the methods disclosed in *Research Disclosure* No. 17643, section XV, pages 28–29, can be used for the coating process.

This invention can be applied to various types of color photosensitive materials.

For example, it can be applied to color reversal films for slides or television purposes, to color reversal papers, and to instant color films, these being typical examples of photosensitive materials according to the invention. Furthermore, it can also be applied to color hard copy materials, for full color copying machines and for storing CRT images. The invention can also be applied to black and white photosensitive materials in which tri-color coupler mixtures are used as disclosed, for example, in *Research Disclosure* No. 17123 (July 1978).

Moreover, the invention can also be applied to black and photographic materials.

The black and white (B/W) direct positive photographic materials (for example, sensitive materials for X-ray purposes, duplicating purposes, micrographic purposes, photographic purposes and printing purposes) disclosed in JP-A No. 59-208540 and JP-A No. 60-260039 are examples of B/W photographic materials according to the invention.

The fogging of the non-prefogged direct positive materials of this invention can be achieved using the light fogging method or the chemical fogging method which are described below. The whole surface exposure, which is to say the fogging exposure, in the light fogging method of this invention is made after imagewise exposure and before and/or during development processing. The imagewise exposed photosensitive material may be immersed in a development bath, or in the development bath pre-bath and exposed, or it may be removed from these baths and exposed without drying, but it is preferably exposed in the development bath.

A light source in the photosensitive wavelength range of the photosensitive material should be used for the light source for the fogging exposure, and in general fluorescent lamps, tungsten lamps, xenon lamps, and sunlight can all be used for this purpose. Specific methods of exposure have been disclosed, for example, British Patent No. 1,151,363, JP-B Nos. 45-12710, 45-12709, 58-6936, JP-A Nos. 48-9727, 56-137350, 57- 129438, 58-62652, 58-60739, 58-70223 (corresponding to U.S. Pat. No. 4,440,851) and JP-A-58-120248 (corresponding to European Patent No. 89101A2). The term "JP-B" used herein signifies an "examined Japanese patent publication". With photosensitive materials which are photosensitive to all wavelength regions, for example, with color photosensitive materials, light sources which have good color rendition (as close to white light as possible) as disclosed in JP-A No. 56-137350 or JP-A No. 58-70223 are best. Light of brightness from 0.01 to 2000 lux, preferably from 0.05 to 30 lux, and most desirably from 0.05 to 5 lux, is appropriate. A light of lower brightness is preferred as the emulsion speed of the photosensitive material increases. The brightness may be adjusted by varying the brightness of the light source or by means of various filters, or by varying the distance or the angle subtended between the photosensitive material and the light source. Furthermore, the brightness of the above mentioned fogging light can also be increased either continuously or in steps from low brightness to high brightness.

The irradiation with light is preferably made after the photosensitive material has been immersed in the development bath or the development pre-bath and the liquid has permeated satisfactorily into the emulsion layer of the photosensitive material. The time from immersion in the bath before making the light fogging exposure is generally from 2 seconds to 2 minutes, preferably from 5 seconds to 1 minute and, most desirably, from 10 seconds to 30 seconds.

The exposure time for fogging is generally from 0.01 seconds to 2 minutes, preferably from 0.1 second to 1 minute, and most desirably from 1 to 40 seconds.

The nucleating agents used in cases where chemical fogging is used in this invention can be included in the photosensitive material or in the photosensitive material processing bath. The inclusion of these compounds in ,the photosensitive material is preferred.

Here, the term "nucleating agent" signifies a substance which is used when carrying out a surface development operation with an internal latent image type silver halide emulsion which has not been pre-fogged and which acts to form a direct positive image. A fogging process in which a nucleating agent is used is preferred in this invention.

When included in the photosensitive material, the nucleating agent is preferably added to the internal latent image type silver halide emulsion layer but, provided that it is adsorbed on the silver halide by diffusion during coating or processing, the nucleating agent may be added to other layers, for example, to the intermediate layers, under-layers or backing layers.

When the nucleating agent is added to a processing bath, it may be included in the development bath or in a pre-bath of low pH as disclosed in JP-A No. 58-178350.

Furthermore, two or more types of nucleating agent can be used conjointly.

The use of compounds represented by formulae (N-I) and (N-II) as nucleating agents is preferred in this invention.

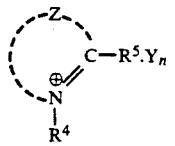

Formula (N-I)

In formula (N-1), Z represents a group of non-metal atoms which is required to form a five or six membered heterocyclic ring, and Z may be substituted with substituent groups. $R^4$ is an aliphatic group, and $R^5$ is hydrogen, an aliphatic group or an aromatic group. $R^4$ and $R^5$ may be substituted with substituent groups. Furthermore, $R^5$ may be bonded to the heterocyclic ring completed by Z to form a ring. However, at least one of the groups represented by $R^4$, $R^5$ and Z includes an alkenyl group, acyl group, hydrazine group or hydrazone group, or $R^4$ and $R^5$ may form a 6-membered ring to form a dihydropyridinium skeleton. Moreover, at least one of the substituent groups of $R^4$, $R^5$ and Z may have a group for promoting adsorption thereof to silver halide. Y is a counter ion for balancing the electrical charge, and n is 0 or 1.)

Specific examples of compounds represented by formula (N-I) are indicated below, but the present invention is not to be construed as being limited thereto.

| | |
|---|---|
| (N-I-1) | 5-Ethoxy-2-methyl-1-propargylquinolinium chloride |
| (N-I-2) | 2,4-dimethyl-1-propargylquinolinium chloride |
| (N-I-3) | 3,4-Dimethyl-dihydro[2,1-b]benzothiazolium chloride |
| (N-I-4) | 6-Ethoxythiocarbonylamino-2-methyl-1-propargylquinolinium trifluoromethanesulfonate |
| (N-I-5) | 6-(5-Benzotriazolecarboxamido)-2-methyl-1-propargylquinolinium trifluoromethanesulfonate |
| (N-I-6) | 6-(5-Benzotriazolecarboxamido)-2-methyl-1-propargylquinolinium iodide |

-continued

| | |
|---|---|
| (N-I-7) | 6-Ethoxythiocarbonylamino-2-(2-methyl-1-propenyl)-1-propargylquinolinium trifluoromethanesulfonate |
| (N-I-8) | 10-Propargyl-1,2,3,4-tetrahydroacridinium trifluoromethanesulfonate |
| (N-I-9) | 7-Ethoxycarbonylamino-10-propargyl-1,2,3,4-tetrahydroacridinium trifluoromethanesulfonate |
| (N-I-10) | 7-[3-(5-mercaptotetrazol-1-yl)benzamido]-10-propargyl-1,2,3,4-tetrahydroacridinium perchlorate |
| (N-I-11) | 7-(5-Mercaptotetrazol-1-yl)-9-methyl-10-propargyl-1,2,3,4-tetrahydroacridinium bromide |
| (N-I-12) | 7-Ethoxythiocarbonylamino-10-propargyl-1,2-dihydroacridinium trifluoromethanesulfonate |
| (N-I-13) | 10-Propargyl-7-[3-(1,2,3,4-thiatriazol-5-ylamino)benzamido]-1,2,3,4-tetrahydro acridinium perchlorate |
| (N-I-14) | 7-(3-Cyclohexylmethoxythiocarbonylamino-benzamido)-10-propargyl-1,2,3,4-tetrahydro-acridinium trifluoromethanesulfonate |
| (N-I-15) | 7-(3-Ethoxythiocarbonylaminobenzamido)-10-propargyl-1,2,3,4-tetrahydroacridinium trifluoromethanesulfonate |
| (N-I-16) | 7-[3-(3-Ethoxythiocarbonylaminophenyl)-ureido]-10-propargyl-1,2,3,4-tetrahydro-acridinium trifluoromethanesulfonate |
| (N-I-17) | 7-(3-Ethoxythiocarbonylaminobenzene sulfonamido)-10-propargyl-1,2,3,4-tetrahydro-acridinium trifluoromethanesulfonate |
| (N-I-18) | 6-[3-{3-[3-(5-Mercaptotetrazol-1-yl)phenyl]-ureido}benzamido]-10-propargyl-1,2,3,4-tetra-hydroacridinium trifluoromethanesulfonate |
| (N-I-19) | 7-[3-(5-mercapto-1,3,4-thiadiazol-1-ylamino)benzamido]-10-propargyl-1,2,3,4-tetrahydroacridinium trifluoromethanesulfonate |
| (N-I-20) | 7-[3-(3-butylthioureido)benzamido]-10-propargyl-1,2,3,4-tetrahydroacridinium trifluoromethanesulfonate |
| Formula (N-II) | $R^{21}-\underset{\underset{R^{23}}{\vert}}{N}-\underset{\underset{R^{24}}{\vert}}{N}-G-R^{22}$ |

In formula (N-II) $R^{21}$ represents an aliphatic group, aromatic group or heterocyclic group, $R^{22}$ represents hydrogen, an alkyl group, aralkyl group, aryl group, alkoxy group, aryloxy group or amino group; G represents a carbonyl group, sulfonyl group, sulfoxy group, phosphoryl group or iminomethylene group (NH=C<); and $R^{23}$ and $R^{24}$ both represent hydrogen, or one represents hydrogen and the other represents an alkylsulfonyl group, arylsulfonyl group or acyl group. Moreover, a hydrazone structure >N—N=C<) may be formed including G, $R^{22}$, $R^{24}$ and the hydrazine nitrogen. Furthermore, where possible, the groups described above may be substituted with substituent groups.

Specific examples of compounds represented by formula (N-II) are indicated below, but the present invention is not to be construed as being limited thereto.

-continued

| | |
|---|---|
| (N-II-1) | 1-Formyl-2-{4-[3-(2-methoxyphenyl)-ureido]phenyl}hydrazine |
| (N-II-2) | 1-Formyl-2-{4-[3-{3-[3-(2,4-di-tert-pentylp-phenoxy)propyl]ureido}phenylsulfonyl-amino]-phenyl}hydrazine |
| (N-II-3) | 1-Formyl-2-{4-[3-(5-mercaptotetrazol-1-yl)benzamido]phenyl}hydrazine |
| (N-II-4) | 1-Formyl-2-[4-{3-[3-(5-mercaptotetrazol-1-yl)phenyl]ureido}phenyl]hydrazine |
| (N-II-5) | 1-Formyl-2-[4-{3-[N-(5-mercapto-4-methyl-1,2,4-triazol-3-yl)carbamoyl]propanamido}-phenyl]hydrazine |
| (N-II-6) | 1-Formyl-2-{4-[3-{N-[4-(3-mercapto-1,2,4-triazol-4-yl)carbamoyl]propanamido}-phenyl]hydrazine |
| (N-II-7) | 1-Formyl-2-[4-{3-[N-(5-mercapto-1.3.4-thiadiazol-2-yl)carbamoyl]propanamido}-phenyl]hydrazine |
| (N-II-8) | 2-[4-(benzotriazol-5-carboxamido)phenyl]-1-formylhydrazine |
| (N-II-9) | 2-[4-{3-[N-(benzotriazol-5-carboxamido)-carbamoyl]propanamido}phenyl]-1-formylhydrazine |
| (N-II-10) | 1-Formyl-2-{4-[1-(N-phenylcarbamoyl)thio-semicarbazido]phenyl}-hydrazine |
| (N-II-11) | 1-Formyl-2-{4-[3-(3-phenylthioureido)-benzamido]phenyl}-hydrazine |
| (N-II-12) | 1-Formyl-2-[4-(3-hexylureido)phenyl]hydrazine |
| (N-II-13) | 1-Formyl-2-{4-[3-(5-mercaptotetrazol-1-yl)benzenesulfonamido]phenyl}hydrazine |
| (N-II-14) | 1-Formyl-2-{4-[3-{3-[3-(5-mercaptotetrazol-1-yl)phenyl]ureido}benzensulfonamido]phenyl} hydrazine |
| (N-II-15) | 1-Formyl-2-[4-{3-[3-(2,4-di-tert-pentyl-phenoxy)propyl]ureido}phenyl]hydrazine |

The nucleating agents used in the invention may be included in the sensitive material or the sensitive material processing bath, and they are preferably included in the sensitive materials. When included in the sensitive material, the nucleating agents are preferably added to the internal latent image type emulsion layer, but the nucleating agent may be added to another layer, for example, to an intermediate layer, subbing layer or backing layer, provided that it diffuses during coating or processing and is adsorbed on the silver halide. When added to a processing bath, the nucleating agent may be included in the development bath or to a pre-bath of low pH as disclosed in JP-A No. 58-178350.

When a nucleating agent is included in a sensitive material it is used in an amount preferably within the range from $10^{-8}$ to $10^{-2}$ mol, and most preferably in an amount within the range from $10^{-7}$ to $10^{-3}$ mol, per mol of silver halide.

Furthermore, when added to a processing bath, the nucleating agent is preferably used at a concentration of from $10^{-5}$ to $10^{-1}$ mol/liter, and most preferably at a concentration of from $10^{-4}$ to $10^{-2}$ mol/liter.

The nucleation accelerators described below can be used in the invention to accelerate the action of the nucleating agents.

Tetraazaindenes, triazaindenes and pentaazaindenes, compounds which have at least one mercapto group which may be substituted optionally with alkali metal atoms or ammonium groups, and the compounds disclosed in JP-A No. 63-106656 (pages 6–16) can be used as nucleation accelerators.

Specific examples of nucleation accelerators are indicated below, but the present invention is not to be construed as being limited to these examples.

| | |
|---|---|
| (A-1) | 3-Mercapto-1,2,4-triazolo[4,5-a]pyridine |
| (A-2) | 3-Mercapto-1,2,4-triazolo[4,5-a]pyrimidine |
| (A-3) | 3-Mercapto-1,2,4-triazolo[1,5-a]pyrimidine |
| (A-4) | 7-(2-Dimethylaminoethyl)-5-mercapto-1,2,4-triazolo[1,5-a]pyrimidine |
| (A-5) | 3-Mercapto-7-methyl-1,2,4-triazolo[4,5-a]pyrimidine |
| (A-6) | 3,6-Dimercapto-1,2,4-triazolo[4,5-a]pyridazine |
| (A-7) | 2-Mercapto-5-methylthio-1,3,4-thiadiazole |
| (A-8) | 3-Mercapto-4-methyl-1,2,4-triazole |
| (A-9) | 2-(3-Dimethylaminopropylthio)-5-mercapto-1,3,4-thiadiazole hydrochloride |
| (A-10) | 2-(2-Morpholinoethylthio)-5-mercapto-1,3,4- |

-continued

| |
|---|
| thiadiazole hydrochloride |

The nucleation accelerators can be included in the photosensitive material or in the processing baths, but inclusion in the photosensitive material in the internal latent image type silver halide emulsion layers or other hydrophilic colloid layers (intermediate layers, or protective layers) is preferred. Inclusion in the silver halide emulsion layers and layers adjacent thereto is especially desirable.

The color development baths used in the development processing of the photosensitive materials of this invention are preferably aqueous alkaline solutions which contain primary aromatic amine based color developing agents as the principal components. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethyl aniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used together, depending on the intended purpose.

A pH of these color developing solution is 9 to 12, preferably 9.5 to 11.5.

The photographic emulsion layers are normally subjected to a bleaching process after color development. The bleaching process may be carried out at the same time as the fixing process (in a bleach-fix process) or it may be carried out as a separate process. Moreover, a bleach-fix process can be carried out after a bleaching process in order to speed up processing. Moreover processing can be carried out in two connected bleach-fix baths, a fixing process can be carried out before carrying out a bleach-fix process or a bleaching process can be carried out after a bleach-fix process, according to the intended purpose of the processing.

The silver halide color photographic materials of this invention are generally subjected to a water washing and/or stabilizing process after the desilvering process. The amount of water used in the water washing process can be determined within a wide range according to the nature of the photosensitive material (for example, the materials, such as couplers, which are being used), the wash water temperature, the number of washing tanks (the number of washing stages), the replenishment system, i.e., whether a counter-flow or a sequential-flow system is sued, and various other conditions. The relationship between the amount of water used and the number of water washing tanks in a multi-stage counter-flow system can be obtained using the method outlined on pages 248–253 of *Journal of the Society of Motion Picture and Television Engineers*, Volume 64 (May 1955).

Color developers can also be incorporated in the silver halide color photosensitive materials of this invention with a view to simplifying and speeding up processing. The use of various color developing agent precursors is preferred.

A variety of known developing agents can be used to develop black and white photosensitive materials in this invention. That is to say, development can be carried out using hydroquinones, for example, hydroquinone, 2-chlorohydroquinone, 2-methylhydroquinone, catechol, and pyrocatechol; amino phenols, for example, p-aminophenol, N-methyl-p-aminophenol, 2,4-diaminophenol; 3-pyrazolidones, for example, 1-phenyl-3-pyrazolidones, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone; and ascorbic acids, and these may be used individually or in combination. Furthermore, the development baths disclosed in JP-A No. 58-55928 can be also used.

The invention is described in greater detail below with reference to specific examples, but the invention is not to be construed as being limited by these examples. Unless otherwise specified, all percents, ratios and parts in the examples are by weight.

EXAMPLE 1

Preparation of Emulsion A-1

Aqueous solutions of potassium bromide and silver nitrate were added simultaneous over a period of about 20 minutes at 75° C. to a vigorously stirred aqueous gelatin solution to which 3,4-dimethyl-1,3-thiazolin-2-thione had been added at the rate of 0.3 gram per mol of silver, and a mono-disperse octahedral silver bromide core emulsion of average gain size about 0.40 μm was obtained. Next, 6 mg of sodium thiosulfate per mol of silver and 7 mg of chloroauric acid (tetra-hydrate) per mol of silver were added to this emulsion and a core chemical sensitization treatment was carried out by heating the mixture to 75° C. for a period of 80 minutes. Shell formation was then carried out on the silver halide core grains so obtained under the same precipitation conditions as above and a mono-disperse core/shell octahedral silver bromide emulsion of average grain size about 0.7 μm was ultimately obtained. The variation coefficient of the grain size was about 10%.

Next, 1.5 mg per mol of silver of sodium thiosulfate and 1.5 mg per mol of silver of chloroauric acid (tetrahydrate) were added to this emulsion, chemical sensitization was carried out for 60 minutes at 60° C. and the internal latent image type silver halide emulsion A-1 was obtained.

Emulsions A-2 to A-20 were obtained in the same way as emulsion A-1 except that the compounds indicated in Table 1 were added immediately after obtaining the core emulsion for Emulsion A-1.

TABLE 1

| Emulsion No. | Compound Amount Added I (mol/mol · Ag) | Compound Amount Added II (mol/mol · Ag) | Compound Amount Added III (mol/mol · Ag) | Compound Amount Added IV (mol/mol · Ag) |
|---|---|---|---|---|
| A-1 | — | — | — | — |
| A-2 | (I-1) $5 \times 10^{-4}$ | — | — | — |
| A-3 | (I-6) $5 \times 10^{-4}$ | — | — | — |
| A-4 | (I-16) $5 \times 10^{-4}$ | — | — | — |
| A-5 | — | (II-3) $5 \times 10^{-4}$ | — | — |
| A-6 | — | — | (III-1) $5 \times 10^{-4}$ | — |
| A-7 | — | — | — | (IV-6) $5 \times 10^{-5}$ |
| A-8 | — | — | — | (IV-16) $5 \times 10^{-5}$ |

TABLE 1-continued

| Emulsion No. | Compound Amount Added I (mol/mol · Ag) | Compound Amount Added II (mol/mol · Ag) | Compound Amount Added III (mol/mol · Ag) | Compound Amount Added IV (mol/mol · Ag) |
|---|---|---|---|---|
| A-9 | — | — | — | (IV-17) $5 \times 10^{-5}$ |
| A-10 | (I-2) $5 \times 10^{-4}$ | — | — | (IV-16) $5 \times 10^{-5}$ |
| A-11 | (I-2) $5 \times 10^{-4}$ | — | — | (IV-17) $5 \times 10^{-5}$ |
| A-12 | (I-6) $5 \times 10^{-4}$ | — | — | (IV-6) $5 \times 10^{-5}$ |
| A-13 | (I-6) $5 \times 10^{-4}$ | — | — | (IV-16) $5 \times 10^{-5}$ |
| A-14 | (I-6) $5 \times 10^{-4}$ | — | — | (IV-17) $5 \times 10^{-5}$ |
| A-15 | (I-16) $5 \times 10^{-4}$ | — | — | (IV-16) $5 \times 10^{-5}$ |
| A-16 | (I-16) $5 \times 10^{-4}$ | — | — | (IV-17) $5 \times 10^{-5}$ |
| A-17 | — | (II-3) $5 \times 10^{-4}$ | — | (IV-16) $5 \times 10^{-5}$ |
| A-18 | — | — | (III-1) $5 \times 10^{-4}$ | (IV-17) $5 \times 10^{-5}$ |
| A-19 | (I-16) $5 \times 10^{-4}$ | (II-3) $5 \times 10^{-4}$ | — | (IV-16) $5 \times 10^{-5}$ |
| A-20 | (I-16) $5 \times 10^{-4}$ | (II-3) $5 \times 10^{-4}$ | (III-1) $5 \times 10^{-4}$ | (IV-16) $5 \times 10^{-5}$ |

The following photographic material was prepared using Emulsion A-1. The support consisted of a paper support (thickness 100 microns) which had been laminated on both sides with polyethylene, and titanium white had been included as a white pigment on the side which was coated.

Photosensitive Layer Composition

The components and coated weights, in units of g/m$^2$, are indicated below. In the case of the silver halide the coated weight is calculated as silver.

| First Layer: Red Sensitive Emulsion Layer | |
|---|---|
| Emulsion A-1 which had been spectrally sensitized with the red sensitizing dyes (Exs-1, 2, 3) | 0.30 |
| Gelatin | 2.00 |
| Cyan coupler (ExC-1) | 0.35 |
| Cyan coupler (ExC-2) | 0.35 |
| Anti-color mixing agent (Equal weights of Cpd-1, 2, 3, 4) | 0.30 |
| Coupler dispersing agent (Cpd-6) | 0.06 |
| Coupler solvent (Equal weights of Solv-1, 2, 3) | 0.02 |
| **Second Layer: Protective Layer** | |
| Acrylic modified copolymer of poly(vinyl alcohol) (17% modification) | 0.04 |
| Equal weights of poly(methyl methacrylate) particles (average particle size 2.4 microns) and silicon oxide (average particle size 5 microns) | 0.10 |
| Gelatin | 3.00 |
| Gelatin hardening agent (H-1) | 0.34 |

ExZK-1 was used at a rate of $10^{-3}$ wt % (with respect to the coated weight of silver halide) as a nucleating agent and $10^{-2}$ wt % (with respect to the coated weight of silver halide) of Cpd-22 as a nucleation accelerator were used in the first layer. Moreover, "Alcanol XC" (DuPont Co.) and sodium alkylbenzenesulfonate were used as emulsification and dispersion promotors and succinic acid ester and "Magefac F-120" (Dainippon Ink Co.) were used as coating promotors for each layer. Moreover, (Cpd-23, 24, 25) was used as a stabilizer in the first layer. The sample obtained was sample 101. The compounds used in this example are described in Example 5.

Samples 102 to 120 were prepared in the same way as Sample 101 except that Emulsions A-2 to A-20 were used in place of Emulsion A-1.

Each of the above mentioned samples was subjected to a wedge exposure (1/10th second, 20 CMS) through a red filter, after which they were developed and processed in the way indicated below.

| Processing Operation | Time | Temp. | Replenishment Rate |
|---|---|---|---|
| Color development | 1 min. 30 sec. | 38° C. | 300 ml/m$^2$ |
| Bleach-fix | 40 seconds | 35° C. | 300 ml/m$^2$ |
| Water wash (1) | 40 seconds | 30-36° C. | |
| Water wash (2) | 40 seconds | 30-36° C. | |
| Water wash (3) | 15 seconds | 30-38° C. | 320 ml/m$^2$ |
| Drying | 30 seconds | 75-80° C. | |

The wash water replenishment system involved replenishing the water wash tank (3) and passing the overflow from water wash tank (3) to water wash tank (2), and passing the overflow from the water wash tank (2) to water wash tank (1), using a counter current replenishment system. The carry over from the previous bath by the photosensitive material was 35 ml/m$^2$ and the replenishment factor was 9.1 times.

| Color Development Bath | |
|---|---|
| Ethylenediamine tetrakismethylene-phosphonic acid | 0.5 g |
| Diethylene glycol | 8.0 g |
| Benzyl alcohol | 12.0 g |
| Sodium bromide | 0.6 g |
| Sodium chloride | 0.5 g |
| Sodium sulfite | 2.0 g |
| N,N-diethylhydroxylamine | 3.5 g |
| Triethylenediamine(1,4-aza-bicyclo[2,2,2]octane | 3.5 g |
| 3-Methyl-4-amino-N-ethyl-N-β-methane sulfonamidoethyl)aniline sulfate | 5.5 g |
| Potassium carbonate | 30.0 g |
| Fluorescent whitener (Stilbene based) | 1.0 g |
| Pure water | to make up to 1000 ml |
| pH | 10.50 |

The pH was adjusted using potassium hydroxide or hydrochloric acid.

| Bleach-fix Bath | |
|---|---|
| Ammonium thiosulfate | 100 g |
| Sodium bisulfite | 21.0 g |
| Ethylenediamine tetraacetic acid, Fe(III) ammonium salt, di-hydrate | 50.0 g |
| Ethylene diamine tetraacetic acid, disodium salt, dihydrate | 5.0 g |
| Pure water | to make up to 1000 ml |
| pH | 6.3 |

The pH was adjusted using aqueous ammonia or hydrochloric acid.

Water Wash Water

Pure water was used. (Mother Bath=Replenisher)

Herein the term "pure water" means city water from which all cations other than the hydrogen ion and all anions other than the hydroxyl ion have been removed to a concentration of less than 1 ppm by means of ion exchange treatment.

The cyan color densities of the direct positive images obtained were measured.

Furthermore, samples which had been aged for 3 days at 60° C., 55% RH were exposed and processed in the same way and density measurements were made.

The results obtained were as shown in Table 2.

TABLE 2

| Sample Number | | Emulsion Number | Before Aging Dmax | Dmin | Relative Speed | Gamma | After Aging 3 Days at 60° C., 55% RH Dmax | Dmin | Relative Speed | Gamma |
|---|---|---|---|---|---|---|---|---|---|---|
| 101 | (Comp. Ex.) | A-1 | 1.90 | 0.32 | 100 | 1.4 | 1.55 | 0.40 | 112 | 0.9 |
| 102 | " | A-2 | 1.90 | 0.13 | 80 | 2.2 | 1.39 | 0.15 | 120 | 1.5 |
| 103 | " | A-3 | 1.90 | 0.13 | 75 | 2.4 | 1.38 | 0.15 | 112 | 1.5 |
| 104 | " | A-4 | 1.91 | 0.10 | 56 | 2.5 | 1.39 | 0.12 | 102 | 1.6 |
| 105 | " | A-5 | 1.89 | 0.18 | 85 | 2.0 | 1.37 | 0.22 | 123 | 1.3 |
| 106 | " | A-6 | 1.90 | 0.19 | 87 | 1.9 | 1.40 | 0.24 | 125 | 1.2 |
| 107 | " | A-7 | 1.91 | 0.32 | 98 | 1.4 | 1.60 | 0.39 | 110 | 0.9 |
| 108 | " | A-8 | 1.90 | 0.31 | 96 | 1.4 | 1.62 | 0.40 | 105 | 1.0 |
| 109 | " | A-9 | 1.90 | 0.32 | 98 | 1.4 | 1.61 | 0.39 | 111 | 0.9 |
| 110 | (Invention) | A-10 | 1.91 | 0.13 | 100 | 2.2 | 1.70 | 0.15 | 105 | 2.1 |
| 111 | " | A-11 | 1.90 | 0.13 | 100 | 2.3 | 1.70 | 0.15 | 102 | 2.2 |
| 112 | " | A-12 | 1.90 | 0.12 | 97 | 2.4 | 1.75 | 0.14 | 100 | 2.3 |
| 113 | " | A-13 | 1.91 | 0.12 | 100 | 1.5 | 1.76 | 0.14 | 102 | 2.3 |
| 114 | " | A-14 | 1.90 | 0.13 | 99 | 2.4 | 1.76 | 0.14 | 100 | 2.2 |
| 115 | " | A-15 | 1.90 | 0.10 | 97 | 2.5 | 1.77 | 0.12 | 101 | 2.3 |
| 116 | " | A-16 | 1.89 | 0.10 | 98 | 2.6 | 1.77 | 0.12 | 100 | 2.4 |
| 117 | " | A-17 | 1.90 | 0.18 | 101 | 2.0 | 1.76 | 0.21 | 105 | 1.9 |
| 118 | " | A-18 | 1.91 | 0.19 | 100 | 1.9 | 1.70 | 0.23 | 103 | 1.7 |
| 119 | " | A-19 | 1.89 | 0.10 | 98 | 2.5 | 1.71 | 0.12 | 102 | 2.3 |
| 120 | " | A-20 | 1.88 | 0.09 | 97 | 2.5 | 1.69 | 0.11 | 100 | 2.3 |

The values of Dmax, Dmin, speed and gamma indicated in the table were determined in the following way. Thus, a characteristic curve like that shown in FIG. 1 was obtained by plotting the log of the exposure on the abscissa and the cyan color density on the ordinate. The cyan color density in the unexposed part was Dmax, the cyan color density in the region which had been adequately exposed was Dmin, the reciprocal of the exposure required to provide a specific cyan color density (D=1) was the speed and a tangent to the characteristic curve was drawn at the point where the cyan color density was Dmin+[(Dmax−Dmin)/3] and the gradient of this tangent after reversing the positive and negative signs was gamma.

The gamma value is a value which indicates the hardness or softness of the gradation.

With Samples 102 to 106 which contained compounds [I] to [III] of this invention individually, the minimum image density (Dmin) was reduced with respect to that of Sample 101 while the maximum image density (Dmax) was retained at a high level, and the gamma value was large and the contrast was high.

However, these samples had a lower speed than Sample 101, and the fall in Dmax and the change in speed on aging were pronounced, and there was also a large decrease in the value of gamma after aging.

The Dmin and gamma values of Samples 107 to 109 which contained compounds [IV] of this invention individually were about the same as those for Sample 101, and the desired effect was not obtained.

In contrast to these comparative samples, with Samples 110 to 120 of this invention which contained at least one compound of general formula (I) to (III) of this invention and a compound [IV] of this invention conjointly, the value of Dmin was reduced while maintaining a high Dmax value, the speed was high and the gamma values showed a high contrast, and in these cases the desired effect was obtained.

Moreover, the samples of this invention exhibited little lowering of Dmax and little change in speed after aging, and the fall in the gamma value after aging was also small, showing that the deterioration in photographic performance of the photosensitive material on storage was slight.

EXAMPLE 2

Emulsions A-21 to A-25 were prepared by changing the time of addition of the compounds (I-16) and (IV-17) in emulsion A-16 in the way shown in Table 3.

TABLE 3

| Emulsion No. | Time at which compound (I-16) and Compound (IV-17) were added |
|---|---|
| A-21 | During the formation of the core emulsion (when 75% of the silver nitrate used for core formation had been added) |
| A-16 | Immediately after forming the core emulsion |
| A-22 | After completing the chemical sensitization of the core |
| A-23 | During the formation of the shell (when 50% of the silver nitrate used to form shell formation had been added) |
| A-24 | Immediately after the shell formation |
| A-25 | After completing the chemical sensitization of the shell |

Samples 221 to 225 were prepared in the same way as Sample 101 except that the emulsions A-21 to A-25 were used in place of the emulsion A-1.

Moreover, Sample 231 was prepared by adding $5\times10^{-4}$ mol/mol Ag of compound (I-16) and $5\times10^{-5}$ mol/mol Ag of compound (IV-17) to Sample 101 after preparing the coating liquid for the first layer.

These samples were exposed and processed in the same way as described in Example 1 and the results obtained on measuring the cyan color densities of the direct positive images obtaining were as shown in Table 4.

TABLE 4

| Sample Number | Emulsion Number | Dmax | Dmin | Relative Speed | Gamma |
|---|---|---|---|---|---|
| 101 (Comp. Ex.) | A-1 | 1.90 | 0.32 | 100 | 1.4 |
| 221 (Invention) | A-21 | 1.90 | 0.10 | 98 | 2.6 |
| 116 (Invention) | A-16 | 1.89 | 0.10 | 98 | 2.6 |
| 222 (Invention) | A-22 | 1.90 | 0.13 | 100 | 2.4 |
| 223 (Invention) | A-23 | 1.90 | 0.15 | 100 | 2.3 |
| 224 (Invention) | A-24 | 1.87 | 0.15 | 98 | 2.2 |
| 225 (Invention) | A-25 | 1.86 | 0.19 | 102 | 2.0 |
| 231 (Invention) | A-1 | 1.86 | 0.20 | 100 | 2.0 |

It is clear from Table 4 that with the samples in which the compounds of this invention had been used the gamma value was large and the contrast higher than that observed when these compounds had not been used, and that the value of Dmin was small and the desired results were obtained. Moreover, in respect of the time at which the compounds of this invention are used, addition during the formation of the emulsion is preferable to addition after the preparation of the coating liquid, and addition during core formation or before chemical sensitization of the core is most desirable.

EXAMPLE 3

Sample 301 was prepared in the same way as Sample 101 in Example 1 except that the nucleating agent ExZK-1 and the nucleation accelerator Cpd-22 were omitted from the first layer (red sensitive emulsion layer) of the sample 101.

Samples 302 to 306 were prepared using emulsions A-3, A-4, A-9, A-14 and A-16 respectively in place of the emulsion A-1 used in Sample 301.

These samples were subjected to a wedge exposure (1/10th second, 20 CMS) through a red filter, after which they were processed in the same way as in Example 1. This time, light of brightness 0.5 lux (color temperature 5400° K.) was directed onto the photosensitive film for 15 seconds, starting 15 seconds after the start of color development.

The cyan color densities of the direct positive images obtained were measured.

Furthermore, samples were exposed and processed in the same way as before after aging for 3 days at 60° C., 55% RH and density measurements were made.

The results obtained were as shown in Table 5.

The minimum image density (Dmin) could be reduced while maintaining a high maximum density (Dmax) with Samples 305 and 306 of this invention, the speeds were high, and the gamma values were large and the samples had high contrast and the desired results were obtained.

Moreover, the samples of this invention showed little reduction of the maximum image density (Dmax) and little change in speed after aging, and the fall in the gamma value after aging was also small, and the deterioration in photographic performance of the photosensitive materials during storage was slight.

EXAMPLE 4

Preparation of Emulsion B-1

A mixed aqueous solution of potassium bromide and sodium chloride and an aqueous solution of silver nitrate were added simultaneously over a period of about 14 minutes at 65° C. to a vigorously stirred aqueous gelatin solution to which 0.07 g per mol of silver of 3,4-dimethyl-1,3-thiazolin-2-thione had been added and a mono-disperse silver chlorobromide emulsion (silver bromide content 80 mol %) of average grain size about 0.23 μm was obtained. Next, 61 mg per mol of silver of sodium thiosulfate and 42 mg per mol of silver of chloroauric acid (tetrahydrate) were added to this emulsion and a chemical sensitization treatment was carried out by heating the mixture to 65° C. for a period of 60 minutes. The silver chloroboromide grains so obtained were used as core grains and a core/shell monodisperse silver chlorobromide (silver bromide content 70 mol %) emulsion of ultimate average grain size 0.65 μm was obtained by growing these grains using the same precipitation conditions as used on the first occasion. The variation coefficient of the grain size was about 12%. Next, 1.5 mg (per mol of silver) of sodium thiosulfate and 1.5 mg (per mol of silver) of chloroauric acid (tetrahydrate) were added to this emulsion, chemical sensitization was carried out by heating to 60° C. for 60 minutes and the internal latent image type silver halide emulsion B-1 was obtained.

Emulsions B-2 to B-8 were obtained in the same way as Emulsion B-1 except that the compounds shown in Table 6 were added immediately after the core emulsion had been obtained in the preparation of Emulsion B-1.

TABLE 5

| Sample Number | | Emulsion Number | Before Aging Dmax | Before Aging Dmin | Before Aging Relative Speed | Before Aging Gamma | After Aging 3 Days at 60° C., 55% RH Dmax | After Aging Dmin | After Aging Relative Speed | After Aging Gamma |
|---|---|---|---|---|---|---|---|---|---|---|
| 301 | (Comp. Ex.) | A-1 | 1.80 | 0.40 | 100 | 1.3 | 1.50 | 0.48 | 115 | 1.0 |
| 302 | " | A-3 | 1.79 | 0.15 | 70 | 2.3 | 1.49 | 0.17 | 112 | 1.7 |
| 303 | " | A-4 | 1.78 | 0.14 | 50 | 2.4 | 1.48 | 0.16 | 108 | 1.8 |
| 304 | " | A-9 | 1.80 | 0.39 | 102 | 1.3 | 1.75 | 0.44 | 104 | 1.0 |
| 305 | (Invention) | A-14 | 1.80 | 0.15 | 100 | 2.3 | 1.74 | 0.17 | 102 | 2.2 |
| 306 | " | A-16 | 1.79 | 0.13 | 98 | 2.4 | 1.74 | 0.15 | 101 | 2.3 |

TABLE 6

| Emulsion No. | Compound Amount Added I (mol/mol · Ag) | Compound Amount Added II (mol/mol · Ag) | Compound Amount Added III (mol/mol · Ag) | Compound Amount Added IV (mol/mol · Ag) |
|---|---|---|---|---|
| B-1 | — | — | — | — |
| B-2 | (I-16) $5 \times 10^{-4}$ | — | — | — |
| B-3 | — | (II-3) $5 \times 10^{-4}$ | — | — |
| B-4 | — | — | (III-1) $5 \times 10^{-4}$ | — |
| B-5 | — | — | — | (IV-17) $5 \times 10^{-5}$ |
| B-6 | (I-16) $5 \times 10^{-4}$ | — | — | " |
| B-7 | — | (II-3) $5 \times 10^{-4}$ | — | " |

TABLE 6-continued

| Emulsion No. | Compound Amount Added I (mol/mol · Ag) | Compound Amount Added II (mol/mol · Ag) | Compound Amount Added III (mol/mol · Ag) | Compound Amount Added IV (mol/mol · Ag) |
|---|---|---|---|---|
| B-8 | — | — | (III-1) $5 \times 10^{-4}$ | " |

Sample 401 was prepared in the same way as Sample 301 in Example 3 except that the emulsion B-1 was used in place of the emulsion A-1 used in Sample 301. Samples 402 to 406 were prepared using Emulsions B-2 to B-8 respectively in place of the emulsion B-1 used in Sample 401.

These samples were exposed and processed in the same way as in Example 3 and the cyan color densities of the direct positive images obtained were measured.

Furthermore, samples which had been aged for 3 days at 60° C., 55% RH were exposed and processed in the same way and density measurements were made.

The results obtained are shown in Table 7.

TABLE 7

| Sample Number | | Emulsion Number | Before Aging Dmax | Dmin | Relative Speed | Gamma | After Aging 3 Days at 60° C., 55% RH Dmax | Dmin | Relative Speed | Gamma |
|---|---|---|---|---|---|---|---|---|---|---|
| 401 | (Comp. Ex.) | B-1 | 2.20 | 0.43 | 100 | 1.2 | 1.90 | 0.55 | 121 | 0.8 |
| 402 | " | B-2 | 2.18 | 0.18 | 48 | 2.2 | 1.85 | 0.20 | 102 | 1.7 |
| 403 | " | B-3 | 2.21 | 0.24 | 65 | 2.0 | 1.90 | 0.27 | 105 | 1.6 |
| 404 | " | B-4 | 2.20 | 0.25 | 76 | 1.9 | 1.87 | 0.28 | 100 | 1.4 |
| 405 | " | B-5 | 2.19 | 0.43 | 98 | 1.2 | 2.12 | 0.50 | 101 | 0.9 |
| 406 | (Invention) | B-6 | 2.18 | 0.18 | 100 | 2.3 | 2.10 | 0.20 | 103 | 2.2 |
| 407 | " | B-7 | 2.20 | 0.23 | 98 | 2.0 | 2.12 | 0.26 | 101 | 1.9 |
| 408 | " | B-8 | 2.19 | 0.25 | 97 | 1.9 | 2.10 | 0.28 | 100 | 1.7 |

With Samples 406 to 408 of this invention, the minimum image density (Dmin) could be reduced while maintaining a high maximum density (Dmax), and the speeds were high and the gamma value was large and the contrast was high, and the desired results were obtained.

Moreover, the samples of this invention exhibited little loss of the maximum image density (Dmax) and little change in speed after aging and there was little reduction in the value of gamma after aging and the deterioration in the photographic performance of the photosensitive material on storage was slight.

EXAMPLE 5

A color photographic material was prepared by the lamination coating of the first to the fourteenth layers indicated below on the surface side, and the fifteenth and sixteenth layers indicated below on the reverse side, of a paper support (thickness 100 microns) which had been laminated on both sides with polyethylene. Titanium oxide as a white pigment and a trace of ultramarine as a blue dye were included in the polyethylene (thickness 30 microns) on the first layer coating side.

Composition of the Photosensitive Layer

The components and coated weights (units: g/m$^2$) are indicated below. Moreover, in the case of the silver halides the coated weight are coated calculated as silver. The emulsions used in each layer were prepared on accordance with the method described for the emulsion A-1. However, a Lippmann emulsion, in which the surface had not been chemically sensitized, was used for the emulsion in the fourteenth layer.

| | |
|---|---|
| First Layer: Anti-halation Layer | |
| Black colloidal silver | 0.10 |
| Gelatin | 0.70 |
| Second Layer: Intermediate Layer | |
| Gelatin | 0.70 |
| Third Layer: Low Speed Red Sensitive Layer | |
| Silver bromide emulsion (average grain size 0.30 μm, size distribution (variation coefficient) 8%, octahedral) which had been spectrally sensitized with the red sensitizing dyes (ExS-1, 2, 3) | 0.04 |
| Silver bromide emulsion (average grain size 0.40 μm, size distribution 10%, octahedral) which had been spectrally sensitized with the red sensitizing dyes (ExS-1, 2, 3) | 0.08 |
| Gelatin | 1.00 |
| Cyan coupler (ExC-1, 2, 3 = 1:1:0.2) | 0.30 |
| Anti-color fading agent (equal weights of Cpd-1, 2, 3, 4) | 0.18 |
| Anti-staining agent (Cpd-5) | 0.003 |
| Coupler dispersion medium (Cpd-6) | 0.03 |
| Coupler solvent (equal weights of Solv-1, 2, 3) | 0.12 |
| Fourth Layer: High Speed Red Sensitive Layer | |
| Silver bromide emulsion (average grain size 0.60 μm, size distribution 15%, octahedral) which had been spectrally sensitized with the red sensitizing dyes (ExS-1, 2, 3) | 0.14 |
| Gelatin | 1.00 |
| Cyan coupler (ExC-1, 2, 3 = 1:1:0.2) | 0.30 |
| Anti-color fading agent (equal weights of Cpd-1, 2, 3, 4) | 0.18 |
| Coupler dispersion medium (Cpd-6) | 0.03 |
| Coupler solvent (equal weights of Solv-1, 1, 3) | 0.12 |
| Fifth Layer: Intermediate Layer | |
| Gelatin | 1.00 |
| Anti-color mixing agent (Cpd-7) | 0.08 |
| Anti-color mixing agent solvent (equal weights of Solv-4, 5) | 0.16 |
| Polymer latex (Cpd-8) | 0.10 |
| Sixth Layer: Low Speed Green Sensitive Layer | |
| Silver bromide emulsion (average grain size 0.25 μm, size distribution 8%, octahedral) which had been spectrally sensitized with the red sensitizing dyes (ExS-4) | 0.04 |
| Silver bromide emulsion (average grain size 0.40 μm, size distribution 10%, octahedral) which had been spectrally sensitized with the green sensitizing dyes (ExS-4) | 0.06 |
| Gelatin | 0.80 |
| Magenta coupler (equal weights of ExM-1, 2, 3) | 0.11 |

-continued

| | |
|---|---|
| Anti-color fading agent (equal weights of Cpd-9, 26) | 0.15 |
| Anti-staining agent (Cpd-10, 11, 12, 13 = 10:7:7:1) | 0.025 |
| Coupler dispersion medium (Cpd-6) | 0.05 |
| Coupler solvent (equal weights of Solv-4, 6) | 0.15 |
| Seventh Layer: High Speed Green Sensitive Layer | |
| Emulsion (A-1) (average grain size 0.70 μm, size distribution 10% octahedral) which had been spectrally sensitized with the green sensitizing dyes (ExS-4) | 0.10 |
| Gelatin | 0.80 |
| Magenta coupler (equal weights of ExM-1, 2, 3) | 0.11 |
| Anti-color fading agent (equal weights of Cpd-9, 26) | 0.15 |
| Anti-staining agent (Cpd-10, 11, 12, 13 = 10:7:7:1) | 0.025 |
| Coupler dispersion medium (Cpd-6) | 0.05 |
| Coupler solvent (equal weights of Solv-4, 6) | 0.15 |
| Eighth Layer: Intermediate Layer | |
| Same as the fifth layer. | |
| Ninth Layer: Yellow Filter Layer | |
| Yellow colloidal silver | 0.12 |
| Gelatin | 0.07 |
| Anti color mixing agent (Cpd-7) | 0.03 |
| Anti-color mixing agent solvent (equal amounts of Solv-4, 5) | 0.10 |
| Polymer latex (Cpd-8) | 0.07 |
| Tenth Layer: Intermediate Layer | |
| Same as the fifth layer. | |
| Eleventh Layer: Low Speed Blue Sensitive Layer | |
| Silver bromide emulsion (average grain size 0.40 μm, size distribution 8%, octahedral) which had been spectrally sensitized with the blue sensitizing dyes (ExS-5, 6) | 0.07 |
| Silver bromide emulsion (average grain size 0.60 μm, size distribution 11%, octahedral) which had been spectrally sensitized with the blue sensitizing dyes (ExS-5, 6) | 0.14 |
| Gelatin | 0.80 |
| Yellow coupler (equal weights of ExY-1, 2) | 0.35 |
| Anti-color mixing agent (Cpd-14) | 0.10 |
| Anti-staining agent (Cpd-5, 15 = 1:5) | 0.007 |
| Coupler dispersion medium (Cpd-6) | 0.05 |
| Coupler solvent (Solv-2) | 0.10 |
| Twelfth Layer: High Speed Blue Sensitive Layer | |
| Silver bromide emulsion (average grain size 0.85 μm, size distribution 18%, octahedral) which had been spectrally sensitized with the blue sensitizing dyes (ExS-5, 6) | 0.15 |
| Gelatin | 0.60 |
| Yellow coupler (equal weights of ExY-1, 2) | 0.30 |
| Anti-color mixing agent (Cpd-14) | 0.10 |
| Anti-staining agent (Cpd-5, 15 = 1:5) | 0.007 |
| Coupler dispersion medium (Cpd-6) | 0.05 |
| Coupler solvent (Solv-2) | 0.10 |
| Thirteenth Layer: Ultraviolet Absorbing Layer | |
| Gelatin | 1.00 |
| Ultraviolet absorber (equal weights of Cpd-2, 4, 16) | 0.50 |
| Anti-color mixing agent (equal amounts of Cpd-7, 17) | 0.03 |
| Dispersion medium (Cpd-6) | 0.02 |
| Ultraviolet absorber solvent (equal amounts of Solv-2, 7) | 0.08 |
| Anti-irradiation dye (Cpd-18, 19, 20, 21, 27 = 10:10:13:15:20) | 0.05 |
| Fourteenth Layer: Protective Layer | |
| Fine grained silver chlorobromide emulsion (97 mol % silver chloride, average grain size 0.1 μm) | 0.03 |
| Acrylic modified copolymer of polyvinyl alcohol | 0.01 |
| Equal weights of poly(methyl methacrylate) particles (average particle size 2.4 μm) and silicon oxide (average particle size 5 μm) | 0.05 |
| Gelatin | 1.80 |
| Gelatin hardening agent (equal weights of H-1 and H-2) | 0.18 |
| Fifteenth Layer: Backing Layer | |
| Gelatin | 2.50 |
| Ultraviolet absorber (equal weights of Cpd-2, 4, 16) | 0.50 |
| Dye (equal weights of Cpd-18, 19, 20, 21, 17) | 0.06 |
| Sixteenth Layer: Backing Protective Layer | |
| Equal weights of poly(methyl methacrylate) particles (average particle size 2.4 μm) and silicon oxide (average particle size 5 μm) | 0.05 |
| Gelatin | 2.00 |
| Gelatin hardening agent (equal weights of H-1 and H-2) | 0.14 |

ExZK-1 and ExZK-2 were used at rates of $10^{-3}$ wt % and $10^{-2}$ wt % (with respect to the silver halide) respectively as nucleating agents and $10^{-2}$ wt % (with respect to the silver halide) of Cpd-22 was used as an nucleation accelerator in each photosensitive layer. Moreover, "Alcanol XC" (DuPont Co.) and sodium alkylbenzenesulfonate were used as emulsification and dispersion promotors and succinate ester and "Magefac F-120" (Dainippon Ink Co.) were used as coating promotors in each layer. Moreover, (Cpd-23, 24, 25) was used as a stabilizer in the silver halide and colloidal silver containing layers. The sample obtained was Sample 501. The compounds used in the examples are indicated below.

ExS-1

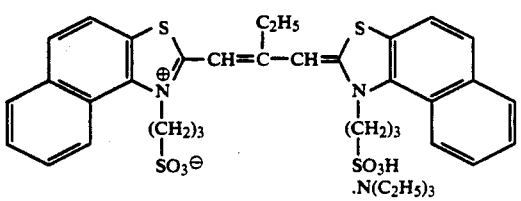

ExS-2

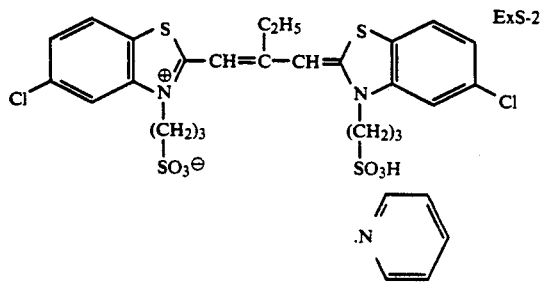

-continued
ExS-3
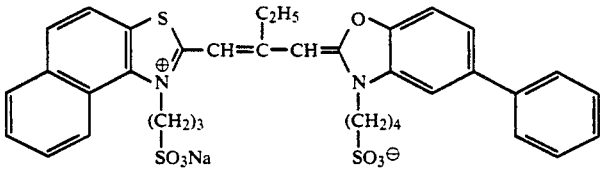
ExS-4
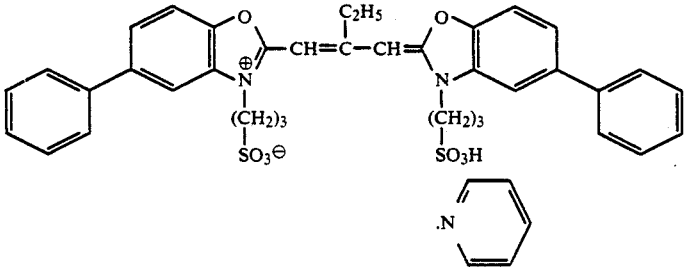
ExS-5
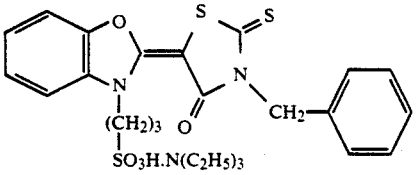
ExS-6
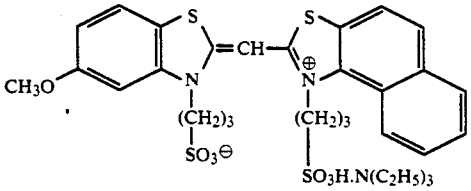
Cpd-1
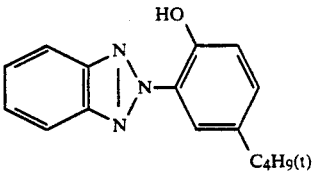
Cpd-2
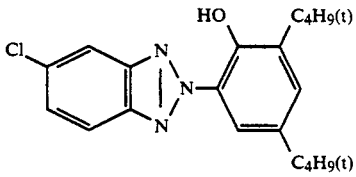
Cpd-3
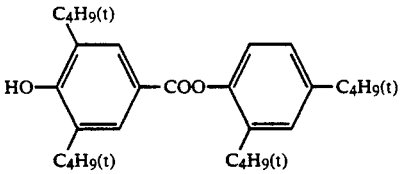
Cpd-4
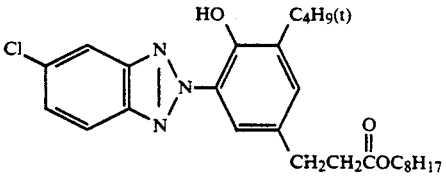
Cpd-5
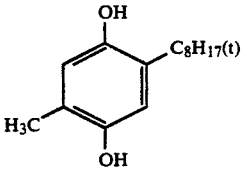
Cpd-6
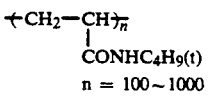
n = 100~1000
Cpd-7
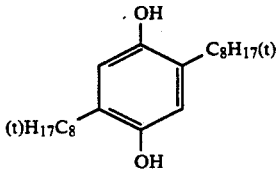
Cpd-8
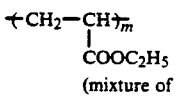
(mixture of m = 10–1000)

-continued
Cpd-9
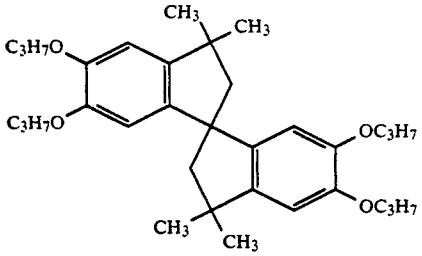
Cpd-10
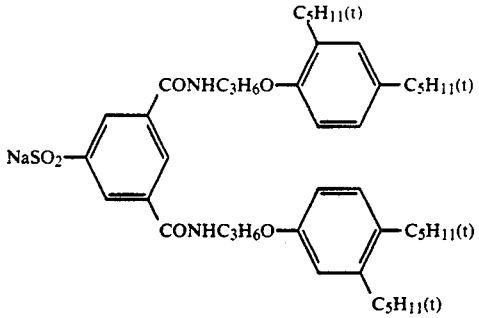
Cpd-11
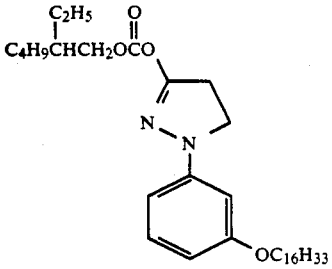
Cpd-12
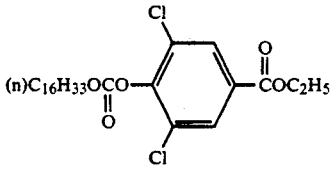
Cpd-13
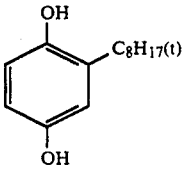
Cpd-14
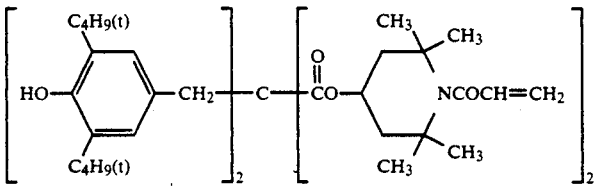
Cpd-15
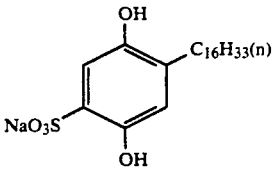
Cpd-16
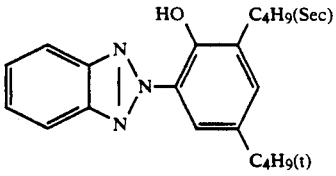
Cpd-17
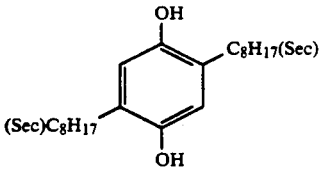
Cpd-18
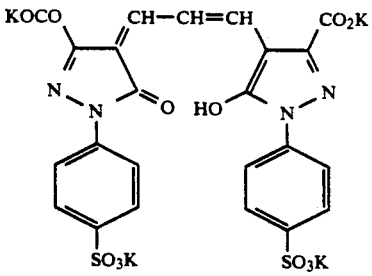
Cpd-19
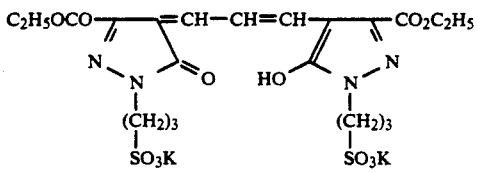

-continued
Cpd-20
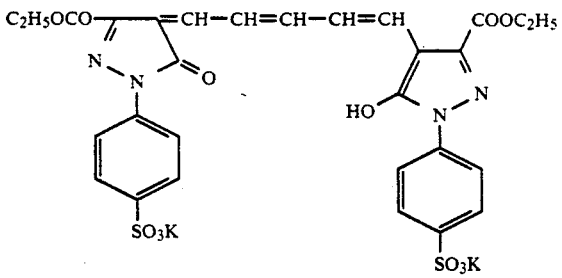
Cpd-21
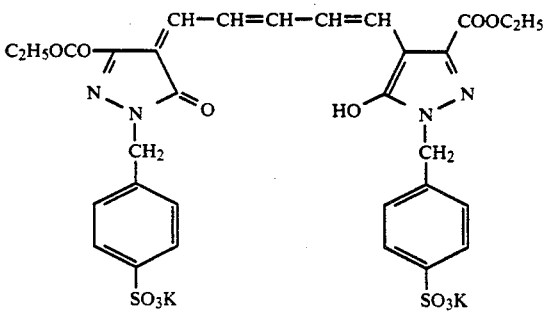
Cpd-22
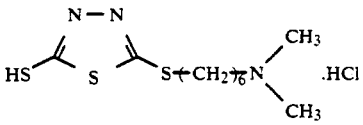
Cpd-23
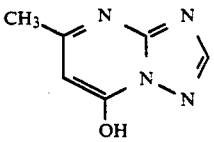
Cpd-24
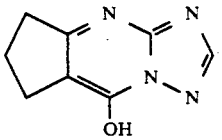
Cpd-25
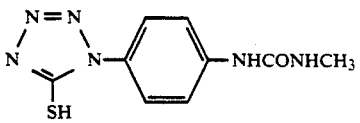
Cpd-26
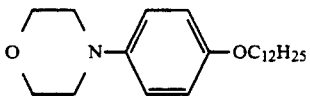
Cpd-27
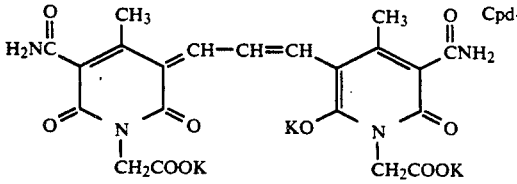
EXC-1
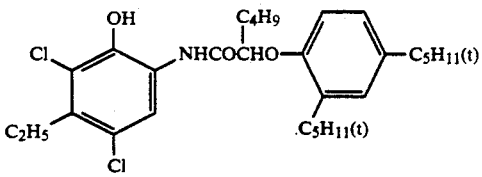
EXC-2
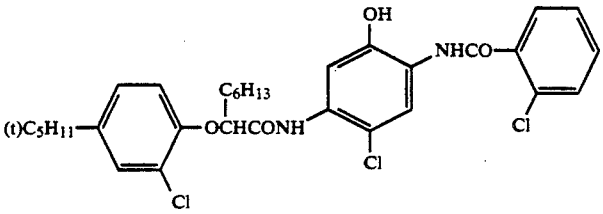

-continued
EXC-3
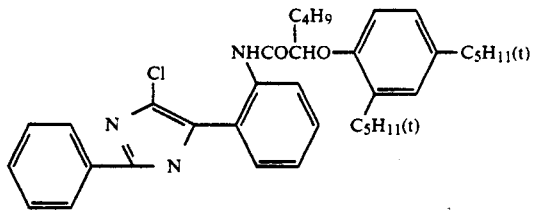
EXM-1
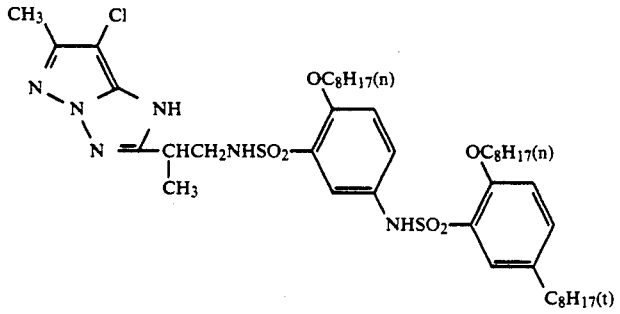
EXM-2
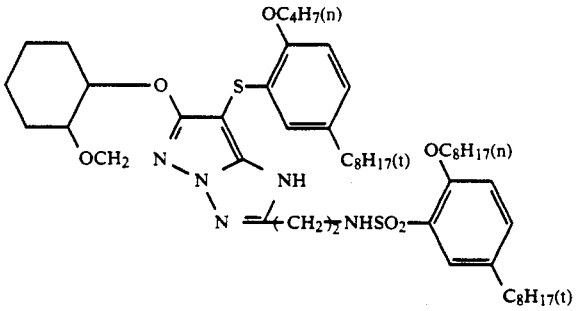
EXM-3
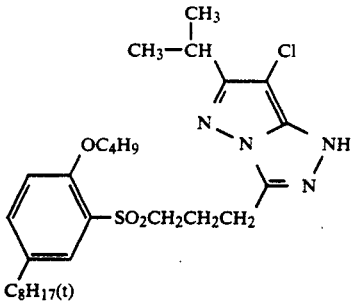
EXY-1
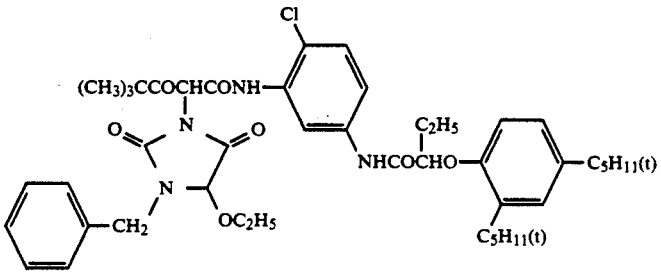

-continued

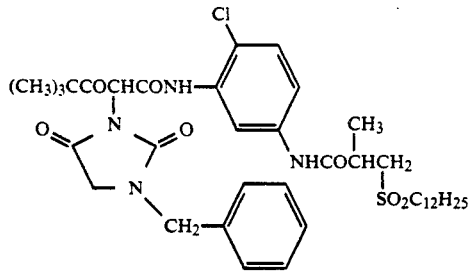

EXY-2

Solv-1 Di(2-ethylhexyl)sebacate
Solv-2 Trinonyl phosphate
Solv-3 Di(3-methylhexyl) phthalate
Solv-4 Tricresyl phosphate
Solv-5 Dibutyl phthalate
Solv-6 Trioctyl phosphate
Solv-7 Di(2-ethylhexyl) phthalate
H-1 1,2-Bis(vinylsulfonylacetamido)ethane
H-2 4,6-dichloro-2-hydroxy-1,3,5-triazine, Na salt
ExZK-1 7-(3-Ethoxythiocarbonylamino-benzamido)-9-methyl-10-propargyl-1,2,3,4-tetrahydroacridinium trifluoromethanesulfonate
ExZK-2 2-[4-{3-[3-{3-[5{3-[2-chloro-5-(1-dodecyloxycarbonylethoxycarbonyl)phenylcarbamoyl]-4-hydroxy-1-naphthylthio}tetrazol-1-yl]phenyl}-ureido]benzenesulfonamido}phenyl]-1-formylhydrazine Samples 502 to 506 were prepared in the same way as Sample 501 except that Emulsions A-3, A-4, A-9, A-14 and A-16 were used in place of the emulsion A-1 in the seventh layer.

These samples were subjected to a wedge exposure (1/10th second, 300 CCMS) and then they were processed in the same way as described in Example 1.

The magenta color densities of the direct positive images obtained were measured.

Furthermore, samples were exposed and processed after aging for 3 days at 60° C, 55% RH and density measurements were made.

The results obtained are shown in Table 8.

TABLE 8

| Sample Number | | Emulsion Number | Before Aging Dmax | Dmin | Relative Speed | Gamma | After Aging 3 Days at 60° C., 55% RH Dmax | Dmin | Relative Speed | Gamma |
|---|---|---|---|---|---|---|---|---|---|---|
| 501 | (Comp. Ex.) | A-1 | 2.40 | 0.35 | 100 | 1.2 | 1.85 | 0.42 | 125 | 0.9 |
| 502 | " | A-3 | 2.40 | 0.17 | 72 | 1.4 | 1.80 | 0.19 | 110 | 1.0 |
| 503 | " | A-4 | 2.39 | 0.15 | 54 | 1.5 | 1.78 | 0.17 | 107 | 1.1 |
| 504 | " | A-9 | 2.41 | 0.34 | 98 | 1.2 | 2.02 | 0.41 | 120 | 0.9 |
| 505 | (Invention) | A-14 | 2.40 | 0.16 | 97 | 1.4 | 2.01 | 0.18 | 100 | 1.3 |
| 606 | " | A-16 | 2.40 | 0.14 | 102 | 1.5 | 2.05 | 0.16 | 105 | 1.4 |

With Samples 505 to 506 of this invention, the minimum image density (Dmin) could be reduced while maintaining a high maximum density (Dmax), when the speeds were high, the gamma value large, and the contrast high, and the desired results were obtained.

Moreover, the samples of this invention exhibited little loss of the maximum image density (Dmax) and little change in speed after aging, and there was little lowering of the gamma value after aging, and the deterioration in the photographic performance of the photosensitive material on storage was slight.

Hence, with the direct positive photographic materials of this invention it is possible to reduce the minimum image density (Dmin) while maintaining a high maximum density (Dmax), when the speeds are high, the gamma value is large and the contrast is high.

Moreover, with the direct positive photographic materials of this invention there is little lowering of the maximum image density (Dmax) and little change in the speed after aging, and there is little lowering of the gamma value after aging. Thus the deterioration in the photographic performance of the photosensitive material on storage is slight.

While the invention has been described in detail and with reference to specific embodiments thereof, it will be apparent to one skilled in the art that various changes and modifications can be made therein without departing from the spirit and scope thereof.

What is claimed is:

1. A process for preparing a direct positive photosensitive material comprising providing on a support at least one silver halide light-sensitive emulsion layer comprising the combination of (a) non-prefogged internal latent image silver halide core/shell grains; (b) a binder; (c) at least one compound represented by Formula (I), (II) or (III); and at least one compound represented by formula (IV):

$$R—SO_2S—M \quad (I)$$

$$R—SO_2S—R^1 \quad (II)$$

$$R—SO_2S—L_m—S.O_2S—R^2 \quad (III)$$

wherein R, $R^1$ and $R^2$ each represents a substituted or unsubstituted aliphatic group, a substituted or unsubstituted aromatic group, or a substituted or unsubstituted heterocyclic group; M represents a cation; L represents a divalent linking group; and m is 0 or 1; and $$R^3—SO_2M^1 \quad \text{(IV)}$$

wherein $R^3$ represents a substituted or unsubstituted aliphatic group, a substituted or unsubstituted aromatic group, or a substituted or unsubstituted heterocyclic group; and $M^1$ represents a cation, wherein said silver halide light-sensitive emulsion layer comprises said compound represented by formula (I), (II) or (III) in an amount of from $10^{-5}$ to $10^{-2}$ mol per mol of said internal latent image silver halide, wherein said silver halide light-sensitive emulsion layer comprises said compound represented by formula (IV) in an amount of from $10^{-7}$ to $10^{-3}$ mol per mol of said internal latent image silver halide, by adding said at least one compound represented by formulae (I), (II) and (III) and said at least one compound represented by formula (IV) during formation of the silver halide core grains or during chemical sensitization of the silver halide core grains.

2. The process as claimed in claim 1, wherein said heterocyclic group represented by R, $R^1$ and $R^2$ is pyrrolidine, piperidine, pyridine, tetrahydrofuran, thiophene, oxazole, thiazole, imidazole, benzothiazole, benzoxazole, benzimidazole, selenezole, benzoselenazole, tellurazole, triazole, benzotriazole, tetrazole, oxadiazole or thiadiazole.

3. The process as claimed in claim 1, wherein each said substituted group R, $R^1$ and $R^2$ is substituted with a substituent selected from the group consisting of an alkyl group, an alkoxy group, an aryl group, a hydroxyl group, a halogen atom, an aryloxy group, an alkylthio group, an arylthio group, an acyl group, a sulfonyl group, an acylamino group, a sulfonylamino group, an acyloxy group, a carboxyl group, a cyano group, a sulfo group and an amino group.

4. The process as claimed in claim 1, wherein said divalent linking group represented by L is selected from $—(CH_2)_m—$, $—CH_2CH{=}CH—CH_2—$, $—CH_2C{\equiv}CCH_2—$,

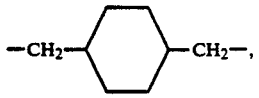

xylylene, phenylene and naphthylene, wherein m is an integer of 1 to 12.

5. The process as claimed in claim 1, wherein said silver halide light-sensitive emulsion layer comprises at least one compound represented by formula (I).

6. The process as claimed in claim 1, wherein said silver halide light-sensitive emulsion layer comprises said compound represented by formula (IV) in an amount of from $10^{-6}$ to $10^{-3}$ mol per mol of said internal latent image silver halide.

7. The process as claimed in claim 1, wherein said non-prefogged internal latent image silver halide comprises at most 3 mol % silver iodide.

8. The process as claimed in claim 7, wherein said non-prefogged internal latent image silver halide contains substantially no silver iodide.

9. The process as claimed in claim 9, wherein said non-prefogged internal latent image silver halide is a monodisperse emulsion having an average grain size of from 0.15 to 1 μm.

10. The process as claimed in claim 1, wherein at least one layer of said material comprises a nucleating agent.

11. The process as claimed in claim 10, wherein said nucleating agent is present in said silver halide light-sensitive emulsion layer.

12. The process as claimed in claim 11, wherein said nucleating agent is represented by formula (N-I):

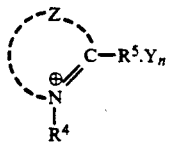

(N-I)

wherein Z represents a non-metallic atomic group necessary for forming a substituted or unsubstituted 5-membered or 6-membered heterocyclic ring; $R^4$ represents a substituted or unsubstituted aliphatic group; and $R^5$ represents hydrogen, a substituted or unsubstituted aliphatic group or a substituted or unsubstituted aromatic group; provided that at least one of $R^4$, $R^5$ and Z comprises an alkenyl group, an acyl group, a hydrazine group or a hydrazone group; Y represents a counter ion required for charge balance; and n is 0 or 1.

13. The process as claimed in claim 12, wherein $R^4$ and $R^5$ are linked to form a dihydropyridinium group.

14. The process as claimed in claim 13, wherein at least one of $R^4$, $R^5$ and Z is substituted with a group capable of promoting adsorption to silver halide.

15. The process as claimed in claim 11, wherein said nucleating agent is represented by formula (N-II):

$$R^{21}—\underset{\underset{R^{23}}{|}}{N}—\underset{\underset{R^{24}}{|}}{N}—G—R^{22} \quad \text{(N-II)}$$

wherein $R^{21}$ represents a substituted or unsubstituted aliphatic group, a substituted or unsubstituted aromatic group or a substituted or unsubstituted heterocyclic group; $R^{22}$ represents hydrogen, a substituted or unsubstituted alkyl group, a substituted or unsubstituted aralkyl group, a substituted or unsubstituted aryl group, a substituted or unsubstituted alkoxy group, a substituted or unsubstituted aryloxy group, or a substituted or unsubstituted amino group; G represents a carbonyl group, a sulfonyl group, a sulfoxy group, a phosphoryl group or an iminomethylene group; at least one of $R^{23}$ and $R^{24}$ represents hydrogen, and the other represents hydrogen, a substituted or unsubstituted alkylsulfonyl group, a substituted or unsubstituted arylsulfonyl group, or a substituted or unsubstituted acyl group; provided that G, $R^{22}$ and $R^{24}$ may be linked to form a hydrazone structure.

16. The process as claimed in claim 11, wherein said nucleating agent is present in an amount of from $10^{-8}$ to $10^{-2}$ mol per mol of said non-prefogged internal latent image silver halide.

17. The process as claimed in claim 16, wherein at least one layer of said material comprises a nucleation accelerator.

* * * * *